US006586147B2

(12) United States Patent
Iida et al.

(10) Patent No.: US 6,586,147 B2
(45) Date of Patent: Jul. 1, 2003

(54) TONER AND FULL-COLOR IMAGE FORMING METHOD

(75) Inventors: Wakashi Iida, Numazu (JP); Takaaki Kohtaki, Mishima (JP); Nobuyoshi Sugawara, Suntoh-gun (JP); Takayuki Itakura, Mishima (JP); Yojiro Hotta, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,039

(22) Filed: Jul. 9, 2001

(65) Prior Publication Data

US 2002/0051924 A1 May 2, 2002

(30) Foreign Application Priority Data

Jul. 10, 2000 (JP) ..... 2000-208026

(51) Int. Cl.[7] ..... G03G 9/087

(52) U.S. Cl. ..... 430/45; 430/108.1; 430/108.8; 430/111.4

(58) Field of Search ..... 430/108.21, 108.1, 430/108.2, 108.8, 45, 111.4, 109.3

(56) References Cited

U.S. PATENT DOCUMENTS

| | | | | |
|---|---|---|---|---|
| 4,921,771 A | | 5/1990 | Tomono et al. | 430/110 |
| 5,384,224 A | | 1/1995 | Tanikawa et al. | 430/106 |
| 5,547,800 A | | 8/1996 | Nishimori et al. | 430/110 |
| 5,578,408 A | | 11/1996 | Kohtaki et al. | 430/106.6 |
| 5,707,771 A | | 1/1998 | Matsunaga | 430/110 |
| 5,744,276 A | | 4/1998 | Ohno et al. | 430/109 |
| 5,851,714 A | | 12/1998 | Taya et al. | 430/110 |
| 5,955,234 A | | 9/1999 | Matsunaga et al. | 430/110 |
| 6,002,903 A | * | 12/1999 | Hayase et al. | 430/109 |
| 6,013,402 A | | 1/2000 | Kanbayashi et al. | 430/45 |
| 6,022,659 A | | 2/2000 | Kanbayashi et al. | 430/106 |
| 6,040,104 A | * | 3/2000 | Nakamura et al. | 430/110 |

FOREIGN PATENT DOCUMENTS

| | | |
|---|---|---|
| JP | 3305 | 1/1977 |
| JP | 3304 | 11/1977 |
| JP | 52574 | 11/1982 |
| JP | 185660 | 7/1989 |
| JP | 185661 | 7/1989 |
| JP | 185662 | 7/1989 |
| JP | 185663 | 7/1989 |
| JP | 107467 | 4/1992 |
| JP | 149559 | 5/1992 |
| JP | 301853 | 10/1992 |
| JP | 61238 | 3/1993 |
| JP | 249735 | 9/1993 |
| JP | 59504 | 3/1994 |
| JP | 92737 | 4/1995 |
| JP | 234542 | 9/1995 |
| JP | 295298 | 11/1995 |
| JP | 54750 | 2/1996 |
| JP | 234480 | 9/1996 |
| JP | 278662 | 10/1996 |
| JP | 171156 | 6/1998 |
| JP | 7151 | 1/1999 |
| JP | 84716 | 3/1999 |

* cited by examiner

*Primary Examiner*—John Goodrow
(74) *Attorney, Agent, or Firm*—Fitzpatrick, Cella, Harper & Scinto

(57) ABSTRACT

A toner, particularly a color toner suitable for full-color image formation through a substantially oil-less heat-pressure fixing device, is formed from at least a binder resin, a colorant and a wax. The toner has viscoelasticity including: a storage modulus at 80° C. ($G'_{80}$) in a range of $1\times10^6$–$1\times10^{10}$ dN/m$^2$, storage moduli at temperatures of 120–180° C. ($G'_{120-180}$) in a range of $5\times10^3$–$1\times10^6$ dN/m$^2$, and loss tangents (tan δ=G"/G' as a ratio between G" (loss modulus) and G' (storage molecules)) including a loss tangent at 180° C. (tan $\delta_{180}$) and a minimum of loss tangents over a temperature range of 120–180 ° C. (tan $\delta_{min}$) satisfying $1 \leqq \tan\delta_{180}/\tan\delta_{min}$. The toner further exhibits a thermal behavior providing a heat-absorption curve according to differential scanning calorimetry (DSC) showing a maximum heat-absorption peak temperature in a range of 50–110° C. in a temperature range of 30–200° C.

33 Claims, 3 Drawing Sheets

TONER AND FULL-COLOR IMAGE FORMING METHOD

FIELD OF THE INVENTION AND RELATED ART

The present invention relates to a toner for image formation by developing electrostatic images or toner jetting, particularly a toner capable of providing high-definition fixed images even when obtained through a heat-pressure fixing means using no or only a limited amount of oil for preventing high-temperature offset. The present invention also relates to a full-color image forming method using such a toner.

Full color copying machines proposed in recent years have generally adopted a process wherein four photosensitive members and a belt-form transfer member are used, electrostatic images formed on the photosensitive members are developed with a cyan toner, a magenta toner, a yellow toner and a black toner, respectively, to form respective toner images on the photosensitive members, and the toner images are successively transferred onto a transfer(-receiving) material conveyed along a straight path between the photosensitive members and the belt-form transfer member to forma full-color image; or a process wherein a transfer(-receiving) material is wound about the circumference of a transfer member with an electrostatic force or a mechanical force exerted by e.g., a gripper, and a development-transfer cycle is repeated four times to form a full color image on the transfer material.

Toners used in such a full-color copying machine are required to exhibit an improved color reproducibility and cause sufficient color mixing in a heat-pressure fixing to provide a full color image with good transparency as required in overhead projector (OHP) images. Compared with an ordinary black toner for mono-chromatic copying machines, a toner for full-color image formation may preferably comprise a relatively low-molecular weight binder resin exhibiting a sharp-melting characteristic. However, a toner comprising such a sharp-melting binder resin is liable to cause a problem of high-temperature offset because of low self-cohesion of the binder resin at the time of toner melting in the heat-pressure fixing step.

For an ordinary black toner for monochromatic copying machine, a relatively high-crystalline wax as represented by polyethylene wax or polypropylene wax has been used as a release agent in order to improve the anti-high-temperature offset characteristic at the time of fixation, as proposed in Japanese Patent Publication (JP-B) 52-3304, JP-B 52-3305 and JP-B 57-52574. When such a high-crystallinity wax is used in a toner for full-color image formation, however, the fixed toner image is liable to have inferior transparency, thus providing a projected image with lower saturation and brightness when projected as an OHP image, because of the high crystallinity and difference in refractive index from an OHP sheet material of the wax.

In order to solve such problems, some toners having a specific storage modulus or viscoelasticities have been proposed.

For example, Japanese Laid-Open Patent Application (JP-A) 11-84716 and JP-A 8-54750 have proposed a toner having a specific storage modulus at 180° C. or 170° C. The toner has tho low a viscosity and has left room for improvement in respect of storage stability in a high temperature environment, when considered as a color toner expected to exhibit a combination of low-temperature fixability and high-temperature offset characteristic, good fixability when fixed by a heat-pressure fixing means using no or only a limited amount of oil for high-temperature offset prevention, and sufficient color mixing characteristic.

JP-A 11-7151 and JP-A 6-59504 have proposed a toner showing specific storage modulus G' at 70–120° C. and specific loss modulus G" at 130–180° C. The toner is not satisfactory in respects of sufficient storability in a high temperature environment, performance of stably providing high-quality images in continuous formation of a large number of image products and stable chargeability and developing performance in various environments.

JP-A 5-249735, JP-A 7-92737, JP-A 7-234542, JP-A 7-295298, JP-A 8-234480, JP-A 8-278662 and JP-A 10-171156 have also proposed toners having specific viscoelasticities. However, then toners still have left room for improvement regarding fixing performances, storage stability and transparency for OHP use (i.e., for providing transparencies used in OHP's (overhead projectors).

In order to solve the above problem, the use of a nucleating agent together with a wax for lowering the wax crystallinity has been proposed in Japanese Laid-Open Patent Application (JP-A) 4-149559 and JP-A 4-107467. The use of waxes having a low crystallinity has been proposed in JP-A 4-301853 and JP-A 5-61238. Montan wax has relatively good transparency and a low-melting point, and the use of montan waxes has been proposed in JP-A 1-185660, JP-A 1-185661, JP-A 1-185662, JP-A 1-185663 and JP-A 1-238672. However, such waxes cannot fully satisfy all the requirements of transparency for OHP use, and low-temperature fixability and anti-high temperature offset characteristic at the time of heat-pressure fixation.

For this reason, it has been generally practiced to minimize or omit such a wax or release agent in an ordinary color toner and apply an oil, such as silicone oil or fluorine-containing oil onto a heat-fixing roller so as to improve the anti-high temperature offset characteristic and the transparency for OHP use. However, according to the measure, the resultant fixed image is liable to have excessive oil on its surface, and the oil is liable to soil the photosensitive member by attachment and swell the fixing roller to shorten the life of the roller. Further, the oil has to be supplied to the fixing roller surface uniformly and at a controlled rate in order to prevent the occurrence of oil lines on the fixed image, and thus tends to require an increase in overall size of the fixing apparatus.

Accordingly, there is a strong desire for a toner which can effectively suppress the occurrence of offset when used in a heat-pressure fixing means omitting or minimizing the use of such an oil for preventing high-temperature offset, and can also provide fixed images with an excellent transparency.

SUMMARY OF THE INVENTION

A generic object of the present invention is to provide a toner having solved the above-mentioned problems of the prior art.

A more specific object of the present invention is to provide a color toner exhibiting excellent transparency for OHP use and anti-high-temperature offset characteristic.

Another object of the present invention is to provide a toner with excellent low-temperature fixability.

Another object of the present invention is to provide a toner with excellent storability, heat-resistance and anti-blocking property.

Another object of the present invention is to provide a toner with stable chargeability which is little affected by a change in environmental conditions of temperature and humidity.

A further object of the present invention is to provide a full-color image forming method capable of providing full-color images with excellent color mixing characteristic and color reproducibility by using substantially no fixing oil.

According to the present invention, there is provided a toner, comprising: at least a binder resin, a colorant and a wax, wherein the toner has viscoelasticity including: a storage modulus at 80° C. ($G'_{80}$) in a range of $1\times10^6$–$1\times10^{10}$ dN/m$^2$, storage moduli at temperatures of 120–180° C. ($G'_{120-180}$) in a range of $5\times10^3$–$1\times10^6$ dN/m$^2$, and loss tangents (tan δ=G"/G' as a ratio between G" (loss modulus) and G' (storage molecules)) including a loss tangent at 180° C. (tan $\delta_{180}$) and a minimum of loss tangents over a temperature range of 120–180° C. (tan $\delta_{min}$) satisfying $1 \leqq \tan\delta_{180}/\tan\delta_{min}$, and the toner exhibits a thermal behavior providing a heat-absorption curve according to differential scanning calorimetry (DSC) showing a maximum heat-absorption peak temperature in a range of 50–110° C. in a temperature range of 30–200° C.

According to the present invention, there is further provided an image forming method, comprising:

(A) an image forming cycle including:

a step of forming an electrostatic image on an image bearing member, a step of developing the electrostatic image with a color toner to form a color toner image on the image bearing member, and a step of transferring the color toner image onto a transfer material via or without via an intermediate transfer member, (B) a process of repeating the image forming cycle (A) four times by using first to fourth color toners, respectively, to form superposed first to fourth color toner images on the transfer material, and (C) a step of fixing the superposed first to fourth color toner images on the transfer material under application of heat and pressure to form a fixed full-color image on the transfer material, wherein the first to fourth color toners are selected successively in an arbitrary order from the group consisting of a cyan toner, a magenta toner, a yellow toner and a black toner, each of the cyan, magenta, yellow and black toners comprises at least a binder resin, a wax and a corresponding colorant selected from the group consisting of a cyan colorant, a magenta colorant, a yellow colorant and a black colorant, the toner has viscoelasticity including: a storage modulus at 80° C. ($G'_{80}$) in a range of $1\times10^6$–$1\times10^{10}$ dN/m$^2$, storage moduli at temperatures of 120–180° C. ($G'_{120-180}$) in a range of $5\times10^3$–$1\times10^6$ dN/m$^2$, and loss tangents (tan 6=G"/G' as a ratio between G' (loss modulus) and G' (storage molecules)) including a loss tangent at 180° C. (tan $\delta_{180}$) and a minimum of loss tangents over a temperature range of 120–180° C. (tan $\delta_{min}$) satisfying $1 \leqq \tan\delta_{180}/\tan\delta_{min}$, and the toner exhibits a thermal behavior providing a heat-absorption curve according to differential scanning calorimetry (DSC) showing a maximum heat-absorption peak temperature in a range of 50–110° C. in a temperature range of 30–200° C.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
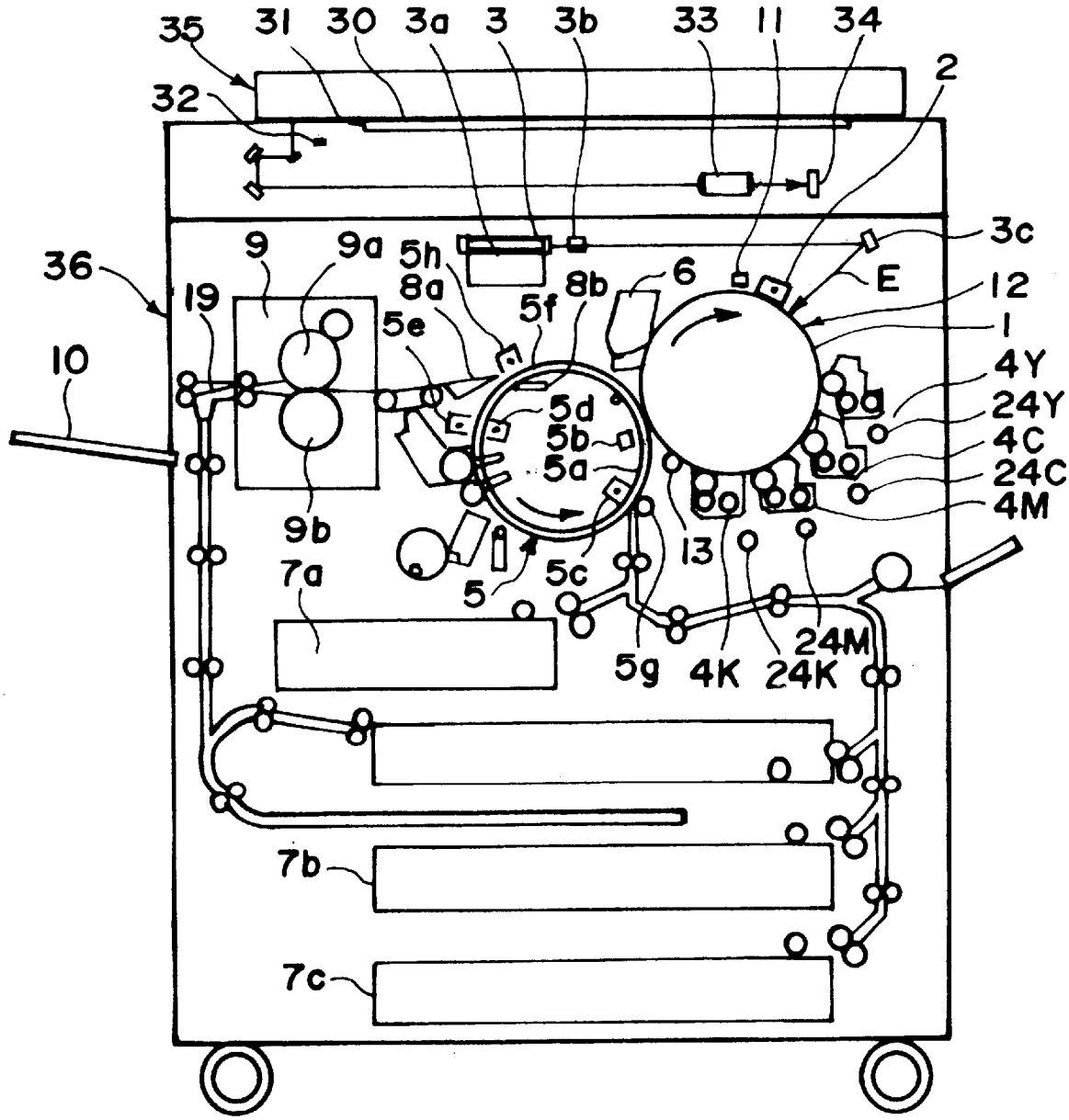
FIG. 1 is a schematic sectional view of an example of full-color image forming apparatus suitable for using the toner of the present invention.

We have studied for obtaining a toner capable of exhibiting long-term storability in a high temperature environment and also a good combination of low-temperature fixability and anti-high-temperature offset characteristic even by using a heat-pressure fixing means using no or a reduced amount of high-temperature offset-preventing oil. As a result, it has been found effective to provide a toner comprising at least a binder resin, a colorant and a wax, and have the toner satisfy the above-mentioned specific parameters of viscoelasticity and thermal behavior.

More specifically, the viscoelastic properties to be satisfied by the toner of the present invention include a storage modulus at 80° C. ($G'_{80}$) of $1\times10^6$–$1\times10^{10}$ dN/m$^2$, preferably $1\times10^6$–$1\times10^8$ dN/m$^2$, so as to exhibit good storability, heat-resistance and anti-blocking property in a high temperature environment. If $G'_{80}$ is below $1\times10^6$ dN/m$^2$, the toner is caused to have lower storability, heat resistance and anti-blocking property, thus being liable to cause coalescence of toner particles and result in a massive toner agglomerate. In recent years, image forming apparatus inclusive of copying machines and printers are caused to have a higher output speed and a smaller size, so that the temperature in the apparatus tends to be higher. Accordingly, it is important for the toner to have sufficient storability, heat resistance and anti-blocking property in a high temperature environment in order to stably obtain high-definition and high-quality images. On the other hand, if $G'_{80}$ is higher than $1\times10^{10}$ dN/m$^2$, the toner may have sufficient storability, heat resistance and anti-blocking property, but the toner fails to exhibit sufficient fixability and color mixability.

The toner is also required to have storage moduli over a temperature range of 120–180° C. ($G'_{120-180}$) within a range of $5\times10^3$–$1\times10^6$ dN/m$^2$, preferably $1\times10^4$–$5\times10^5$ dN/m$^2$. If $G'_{120-180}$ can be lower than $5\times10^3$ dN/m , the toner fails to exhibit good anti-high-temperature offset characteristic. If $G'_{120-180}$ can exceed $1\times10^6$ dN/m$^2$, the toner fails to exhibit good low-temperature fixability and color mixability.

In order to exhibit sufficient high-temperature-offset characteristic, good storability and anti-blocking property, the toner is required to exhibit loss tangents (tan δ=G"/G' as a ratio between G" (loss modulus) and G' (storage modulus)) including a loss tangent at 180° C. (tan $\delta_{180}$) and a minimum of loss tangents over a temperature range of 120–180° C. (tan $\delta_{min}$) satisfying $1 \leqq \tan\delta_{180}/\tan\delta_{min}$. If the ratio tan $\delta_{180}/\tan\delta_{min}$ is below 1, the toner is caused to have lower anti-high-temperature offset property. Further, in the case of being left to stand for a long period in a high temperature environment, the toner is caused to have lower storability and anti-blocking property, thus resulting in coalescence of toner particles.

In order to satisfy both low-temperature fixability and anti-blocking property, the toner is also required to exhibit a thermal behavior providing a heat-absorption curve according to differential scanning calorimetry (DSC) showing a maximum heat-absorption peak temperature (Tabs.max) in a range of 50–110° C., preferably 60–90° C., in a temperature range of 30–200° C. For a similar reason, it is preferred that the toner exhibits a thermal behavior providing a heat-evolution curve according to DSC showing a maximum heat-evolution peak temperature (Tevo.max) in a range of 40–90° C., more preferably 45–85° C. If Tabs.max exceeds 110° C. or Tevo.max exceeds 90° C., the toner is liable to have inferior low-temperature fixability. If Tabs.max is below 50° C. or Tevo.max is below 40° C., the toner is caused to have lower anti-blocking property.

It is further preferred that the toner exhibits Tabs.max and Tevo.max satisfying Tabs.max−Tevo.max≦10° C.

It is further preferred that the toner of the present invention show storage moduli over a temperature range of 120–180° C. ($G'_{120-180}$) including a minimum (G'min) and a maximum (G'max) providing a ratio (G'max/G'min) of at most 20. If the ratio (G'max/G'min) exceeds 20, the fixed images are liable to have different gloss so that it becomes difficult to stably obtain high-quality images when a large number of image products are produced. It is further preferred for the toner to show $G'_{80}=1\times10^6–9\times10^7$ dN/m$^2$, more preferably $2\times10^6–5\times10^7$ dN/m$^2$, for exhibiting good low-temperature fixability, anti-blocking property and transparency of fixed images for OHP use. It is further preferred for the toner to show a storage modulus at 120° C. ($G'_{120}$) of $1\times10^4–8\times10^5$ dN/m$^2$, more preferably $2\times10^4–7\times10^5$ dN/m$^2$, for exhibiting good color mixability and continuous image forming performance on a large number of sheets.

It is also preferred that the binder resin constituting the toner of the present invention comprises (a) a polyester resin, (b) a hybrid resin comprising a polyester unit and a vinyl (co-)polymer unit or (c) a mixture of these. It is further preferred that the toner contains a tetrahydrofuran (THF)-soluble component showing a molecular weight distribution as measured according to gel-permeation chromatography (GPC) including a main-peak molecular weight (Mp) in a range of 3,500–15,000, more preferably 4,000–13,000, and ratio (Mw/Mn) between a weight-average molecular weight (Mw) and a number-average molecular weight (Mn) of at least 300, more preferably at least 500. If Mp is below 3,500, the toner is caused to have a lower anti-high-temperature offset characteristic. On the other hand, if Mp exceeds 15,000, the toner is liable to have an inferior low-temperature fixability and provide lower transparency for OHP use. If the ratio Mw/Mn is below 300, the toner is caused to have a lower anti-high-temperature offset property.

The polyester resin as a preferred species of the binder resin constituting the toner of the present invention may be formed from an alcohol, and a carboxylic acid, a carboxylic acid anhydride or a carboxylic acid ester, as starting monomers. More specifically, examples of dihydric alcohol may include: bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane; ethylene glycol, diethylene glycol, triethylene glycol, 1,2-propylene glycol, 1,4-butanediol, neopentyl glycol, 1,4-butene-diol, 1,5-pentane-diol, 1,6-hexane-diol, 1,4-cyclohexane-dimethanol, dipropylene glycol, polyethylene glycol, polypropylene glycol, polytetramethylene glycol, bisphenol A and hydrogenated bisphenol A.

Examples of alcohols having three or more hydroxy groups may include: sorbitol, 1,2,3,6-hexane-tetrol, 1,4-sorbitan, pentaerythritol, dipenta-erythritol, tripentaerythritol, 1,2,4-butanetriol, 1,2,5-pentanetriol, glycerol, 2-methylpropanetriol, trimethylolethane, trimethylol propane, and 1,3,5-trihydroxymethylbenzene.

Examples of the acid may include: aromatic dicarboxylic acids, such as phthalic acid, isophthalic acid and terephthalic acid, and anhydrides thereof; alkyldicarboxylic acids, such as succinic acid, adipic acid, sebacic acid and azelaic acid, and anhydrides thereof; alkyl-substituted succinic acids substituted with an alkyl group having 6–12 carbon atoms, and anhydrides thereof; and unsaturated dicarboxylic acids, such as fumaric acid, maleic acid and citraconic acid, and anhydrides thereof.

Among polyester resins formed by reaction between the above-mentioned diols and acids, those formed as polycondensates between a bisphenol derivative represented by formula (1) shown below, and a carboxylic acid selected from carboxylic acids having two or more carboxyl groups, anhydrides thereof or lower alkyl ester thereof (e.g., fumaric acid, maleic acid, maleic anhydride, phthalic acid, terephthalic acid, trimellitic acid, and pyromellitic acid), are preferred so as to provide a color toner having a good chargeability:

(1)

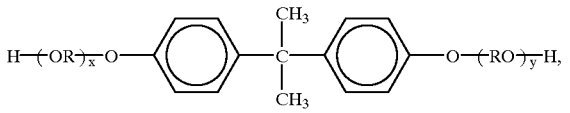

wherein R denotes an ethylene or propylene group, x and y are independently a positive integer of at least 1 with the proviso that the average of x+y is in the range of 2–10.

The hybrid resin used as another preferred species of the binder resin constituting the toner of the present invention means a resin comprising a vinyl copolymer unit and a polyester unit chemically bonded to each other. More specifically, such a hybrid resin may be formed by reacting a polyester unit with a vinyl polymer unit obtained by polymerization of a monomer having a carboxylate ester group such as a (meth)acrylate ester or with a vinyl polymer unit obtained by polymerization of a monomer having a carboxyl group such as (meth)acrylic acid through transesterification or polycondensation. Such a hybrid resin may preferably assume a form of a graft copolymer (or a block copolymer) comprising the polyester unit as a trunk polymer and the vinyl polymer unit as the branch polymer.

Examples of a vinyl monomer to be used for providing the vinyl polymer unit of the hybrid resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethyl-styrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polylenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinyl-carbazole, N-vinylindole, and N-vinyl pyrrolidone; vinylnaphthalenes; acrylic acid derivatives or methacrylic acid derivatives, such as acrylonitrile, methacryronitrile, and acrylamide; esters of the below-mentioned α,β-unsaturated acids and diesters of the below-mentioned dibasic acids.

Examples of carboxy group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing vinyl monomer: inclusive of acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl)-styrene.

In the binder resin according to the present invention, the vinyl polymer unit can include a crosslinking structure obtained by using a crosslinking monomer having two or more vinyl groups, examples of which are enumerated hereinbelow. Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)-propanediacrylate, and compounds obtained by substituting methacrylate groups for the acrylate groups in the above compounds.

Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

In the present invention, it is preferred that the vinyl polymer component and/or the polyester resin component contain a monomer component reactive with these resin components. Examples of such a monomer component constituting the polyester resin and reactive with the vinyl resin may include: unsaturated dicarboxylic acids, such as phthalic acid, maleic acid, citraconic acid and itaconic acid, and anhydrides thereof. Examples of such a monomer component constituting the vinyl polymer and reactive with the polyester resin may include: carboxyl group-containing or hydroxyl group-containing monomers, and (meth)acrylate esters.

In order to obtain a binder resin mixture containing a reaction product between the vinyl resin and polyester resin, it is preferred to effect a polymerization reaction for providing one or both of the vinyl resin and the polyester resin in the presence of a polymer formed from a monomer mixture including a monomer component reactive with the vinyl resin and the polyester resin as described above.

Examples of polymerization initiators for providing the vinyl polymer unit according to the present invention may include: 2,2'-azobisisobutyro-nitrile, 2,2'-azobis(4-methoxy-2,4-dimethylvalero-nitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane); ketone peroxides, such as methyl ethyl ketone peroxide, acetylacetone peroxide, and cyclohexanone peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxy-carbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyiso-phthalate, t-butyl peroxyallylcarbonate, t-amyl peroxy-2-ethylhexanoate, di-t-butyl peroxyhexahydro-terephthalate, and di-t-butyl peroxyazelate.

The binder resin for constituting the toner according to the present invention may for example be produced according to the following methods (1)–(6):

(1) The vinyl resin, the polyester resin and the hybrid resin are separately formed and then blended. The blending may be performed by dissolving or swelling the resins in an organic solvent, such as xylene, followed by distilling-off of the organic solvent. The hybrid resin may be produced as a copolymer by dissolving or swelling a vinyl resin and a polyester resin prepared separately in advance in a small amount of an organic solvent, followed by addition of an esterification catalyst and an alcohol and heating to effect transesterification.

(2) A vinyl resin is first produced, and in the presence thereof, a polyester resin and hybrid resin component are produced. The hybrid resin component may be produced through a reaction of the vinyl resin (and a vinyl monomer optionally added) with polyester monomers (such as an alcohol and a carboxylic acid) and/or a polyester. Also in this case, an organic solvent may be used as desired.

(3) A polyester resin is first produced, and in the presence thereof, a vinyl resin and a hybrid resin component are produced. The hybrid resin component may be produced through the reaction of the polyester resin (and polyester monomers optionally added) with vinyl monomers and/or a vinyl resin in the presence of an esterification catalyst.

(4) A vinyl resin and a polyester resin are first produced, and in the presence of these resins, vinyl monomers and/or polyester monomers (alcohol and carboxylic acid) are added thereto for polymerization and transesterification. Also this instance, an organic solvent may be used as desired.

(5) A hybrid resin is first prepared, and then vinyl monomers and/or polyester monomers are added to effect addition polymerization and/or polycondensation. In this instance, the hybrid resin may be one prepared in the methods of (2)–(4), or may be one produced through a known process. An organic solvent may be added as desired.

(6) Vinyl monomers and polyester monomers (alcohol and carboxylic acid) are mixed to effect addition polymerization and polycondensation successively to provide a vinyl resin, a polyester resin and a hybrid resin component. An organic solvent may be added as desired.

In the above methods (1)–(5), the vinyl resin and/or the polyester resin may respectively comprise a plurality of polymers having different molecular weights and crosslinking degrees.

In the hybrid resin for constituting the binder resin of the toner according to the present invention, the vinyl polymer unit and the polyester unit may preferably be contained in a weight ratio (vinyl polymer unit/polyester unit) of at most 1.0, more preferably at most 0.5. In other words, the vinyl polymer unit and the polyester unit may preferably be used in a weight ratio of 0.5:99.5–50:50.

Further to say, the binder resin constituting the toner of the present invention may comprise any of the following, i.e., (i) a hybrid resin comprising a polyester unit and a vinyl (co-)polymer unit, (ii) a mixture of the hybrid resin and a polyester resin, (iii) a mixture of the hybrid resin and a vinyl copolymer, (d) a polyester resin, and (e) a mixture of a poyester resin and a vinyl copolymer. For the purpose of obtaining sufficient anti-high-temperature offset characteristic, heat resistance and anti-blocking property, it is preferred to use a mixture of a vinyl copolymer and a polyester resin, or a hybrid resin having a polyester unit and a vinyl copolymer unit.

The binder resin constituting the toner of the present invention may preferably have a glass transition temperature of 40–90° C., more preferably 45–85° C. The binder resin may preferably have an acid value of 1–40 mgKOH/g.

The toner of the present invention may preferably contain one or more species of waxes.

Examples of the waxes usable in the present invention may include: aliphatic hydrocarbon waxes, such as low-molecular weight polyethylene, low-molecular weight polypropylene, microcrystalline wax, and paraffin wax, oxides of aliphatic hydrocarbon waxes, such as oxidized polyethylene wax, and block copolymers of these; waxes principally comprising aliphatic acid esters, such as carnauba wax, Sasol wax and montaic wax acid ester; partially or wholly deacidified aliphatic acid esters, such as deacidified carnauba wax. Further examples may include: saturated linear aliphatic acids, such as palmitic acid, stearic acid and montanic acid; unsaturated aliphatic acids, such as brassidic acid, eleostearic acid and valinaric acid; saturated alcohols, such as stearyl alcohol, arakidyl alcohol, behenyl alcohol, carnaubyl alcohol, ceryl alcohol and melissyl alcohol; polybasic alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocabon waxes; partially esterified products between aliphatic acid and polyhydric alcohols, such as behenic acid monoglyceride; and methyl ester compounds having hydroxyl groups obtained by hydrogenating vegetable oil and fat.

A particularly preferred class of waxes usable in the present invention may include aliphatic hydrocarbon waxes; a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; a hydrocarbon wax obtained by subjecting a mixture gas containing carbon monoxide and hydrogen to the Arge process to form a hydrocarbon mixture and distilling the hydrocarbon mixture to recover a residue; and hydrogenation products of the above. Fractionation of wax may preferably be performed by the press sweating method, the solvent method, vacuum distillation or fractionating crystallization to recover a fractionated wax. As the source of the hydrocarbon wax, it is preferred to use hydrocarbons having up to several hundred carbon atoms as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few branches. It is further preferred to use hydrocarbon waxes synthesized without polymerization because of their structure and molecular weight distribution suitable for easy fractionation.

The wax may preferably have a molecular weight distribution showing a main peak in a molecular weight region of 400–2400, more preferably 430–2000, so as to provide the toner with preferably thermal characteristic.

In order to provide a toner with excellent fixing performances, the toner may preferably have a melting point (in terms of a maximum heat-absorption peak temperature on a DSC curve) in a temperature range of 60–100° C., more preferably 65–90° C.

The wax may preferably be contained in 0.1–20 wt. parts, more preferably 0.5–10 wt. parts per 100 parts by weight of the binder resin.

The wax may ordinally be admixed with the binder resin by adding the wax to a solution of the binder resin in a solvent at an elevated temperature or in a mixture of other toner ingredients such the binder resin and colorant under melt-kneading.

The toner of the present invention may preferably have a weight-average particle size (D4) of 4–10 μm, more preferably 5–9 μm. It is further preferred that the toner has a number-average particle size (D1) of 3.5–9.5 μm and shows a particle size distribution of particles of 2 μm or larger including 5–50% by number of particles of 2–4 μm and at most 5% by volume of particles of 12.70 μm or larger.

D4>10 μm means that a fraction of small particles contributing to high-quality image production is small in amount, so that it becomes difficult to faithfully develop minute electrostatic images on a photosensitive drum, thus lowering the reproducibility of highlight image and lowering the resolution. Further, an excessively large amount of toner is liable to be attached onto the electrostatic image, thus resulting in increased toner consumption.

On the other hand, if D4<4 μm, the toner is liable to have an excessive charge per unit weight, so that the image density is liable to be lowered, particularly in a low temperature/low humidity environment. This is particularly unsuitable for development of an image having a large image area percentage, such as a graphic image.

Further, if D4<4 μm, it becomes difficult to triboelectrically charge the toner with a contact charging member, such as a carrier, and an increased fraction of toner fails to be sufficiently charged, so that the developed image is liable to be accompanied with noticeable fog caused by scattering to non-image parts. It may be conceived of using a smaller particle size of carrier for increasing the specific surface area of the carrier in order to cope with the problem. In the case of a toner of D4<4 μm, however, the toner is also liable to cause self-agglomeration, so that it is difficult to realize a uniform mixing with the carrier in a short time, and fog is liable to occur in continuous image formation performed while replenishing the toner.

It is further preferred that the toner of the present invention includes 5–50% by number, more preferably 5–25% by number, of toner particles of 4 μm or smaller. If the toner particles of 4 μm or smaller is less than 5% by number, the content of small particle size toner fraction as an essential for high-quality image formation becomes small, and is particularly decreased on continuation of copying or printing, so that the balance of toner particle size distribution is liable to be disordered, thus gradually resulting in images of inferior image quality.

On the other hand, if the toner particles of 4 μm or smaller exceeds 50% by number, the toner particles are liable to agglomerate with each other, thus functioning as massive toner particles exceeding a proper size to result in images with a rough appearance, lower resolution, and with an appearance of hollow image due to a large density difference between edges and inside of an image pattern. In order to improve the image quality, it is preferred that the toner contains at most 7% by volume of toner particles of 12.70 μm or larger.

The colorant used in the toner of the present invention may comprise a pigment and/or a dye.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a phthalocyanine skeleton to which 1–5 phthalimidomethyl groups are added.

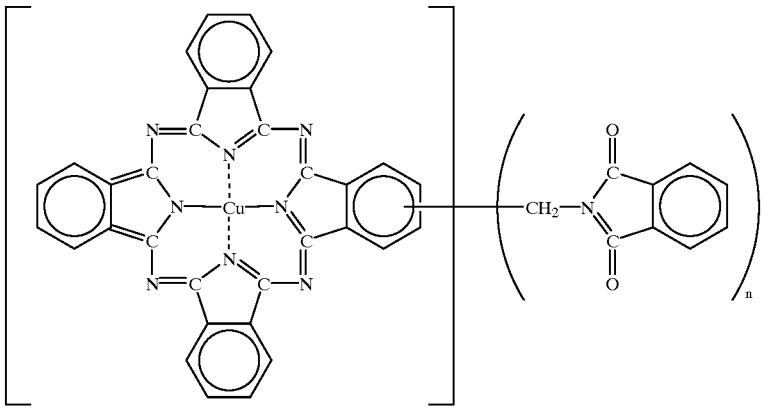

wherein n is an integer of 1–5.

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

It is also possible to use dyes, such as C.I. Direct Green 6, C.I. Basic Green 4, C.I. Basic Green 6, and Solvent Yellow 162.

Examples of black colorant used in the present invention may include: carbon black, magnetic material, and black colorant mixtures of the above-mentioned yellow/magenta/cyan colorants.

The colorant may preferably be used in an amount of 0.1–15 wt. parts, more preferably 0.5–12 wt. parts, most preferably 2–10 wt. parts, per 100 wt. parts of the binder resin.

The organometallic compound preferably contained in the toner of the present invention may preferably be an organometallic compound of an aromatic carboxylic acid and a metal having a valence of at least two.

Preferred examples of the aromatic carboxylic compound may include those represented by the following these formula:

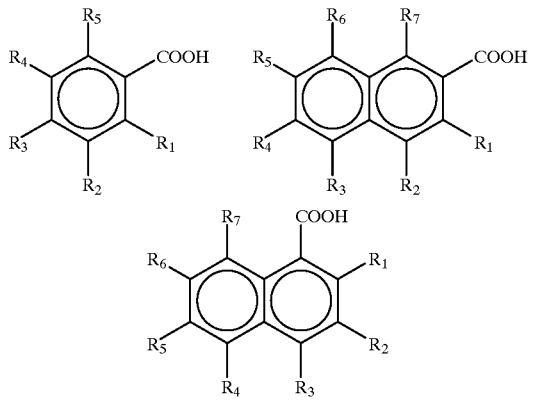

wherein $R_1$–$R_7$ independently denote a hydrogen atom, an alkyl group having 1–12 carbon atoms, an alkenyl group having 2–12 carbon atoms, —OH, —$NH_2$, —$NH(CH_3)$, —$N(CH_3)_2$, —$OCH_3$, —$OC_2H_5$, —COOH or —$CONH_2$.

$R_1$ may preferably be a hydroxyl group, an amino group or a methoxy group, particularly a hydroxyl group. A preferred class of the aromatic carboxylic acid may be a dialkylsalicylic acid, such as di-tert-butylsalicylic acid.

The metal constituting the organometallic compound may preferably be a metal atom having a valence of at least 2. Examples of the divalent metal may include: $Mg^{2+}$, $Ca^{2+}$, $Sr^{2+}$, $Pb^{2+}$, $Fe^{2+}$, $Co^{2+}$, $Ni^{2+}$, $Zn^{2+}$ and $Cu^{2+}$, among which $Zn^{2+}$, $Ca^{2+}$, $Mg^{2+}$ and $Sr^{2+}$ ar preferred. Examples of the metal having a valence of 3 or lager may include: $Al^{3+}$, $Cr^{3+}$, $Fe^{3+}$ and $Zn^{2}$ are preferred, and $Al^{3+}$ is particularly preferred.

As an organometallic compound used in the present invention, an aluminum compound or a zinc compound of di-tert-butylsalicylic acid is preferred, and particularly di-tert-butylsalicylic acid aluminum compound is preferred.

An aromatic carboxylic acid metal compound may for example be synthesized through a process of dissolving an aromatic carboxylic acid in a sodium hydroxide aqueous solution, adding an aqueous solution of a metal having a valence of at least 2 dropwise thereto, and heating under stirring the aqueous mixture, followed by pH adjustment of the aqueous mixture, cooling to room temperature, filtration and washing with water. The synthesis process is not restricted to the above.

The organometallic compound may preferably be used in 0.1–10 wt. parts, more preferably 0.5–9 wt. parts, per 100 wt. parts of the binder resin so as to adequately adjust the viscoelasticity and triboelectric chargeability of the toner.

In order to further stabilize the chargeability of the toner according to the present invention, it is also possible to use a charge control agent, as desired, other than the above-mentioned organometallic compound. Examples of such charge control agent may include: nigrosine and imidazole compound. Such a charge control agent may be used in 0.1–10 wt. parts, preferably 0.1–7 wt. parts, per 100 wt. parts of the binder resin.

It is also preferred to obtain the toner of the present invention by blending toner particles with an externally added flowability-improving agent so as to provide an improved storability in a high-temperature-environment. The flowability-improving agent may preferably comprise fine powder of inorganic materials, such as silica, titanium oxide, or aluminum oxide. It is preferred that such inorganic fine powder has been made hydrophobic by treatment with a hydrophobizing agent, such as a coupling agent, silicone oil or a mixture of these.

Examples of the coupling agent may include silane coupling agents, titanate coupling agents, aluminum coupling agents, and zirco-aluminate coupling agents.

Specific examples of the silane coupling agents may include those represented by a formula of $R_mSiY_n$, wherein R denotes an alkoxy group; m denotes an integer of 1–3; Y denotes a group, such as alkyl, vinyl, phenyl, methacryl, amin, epoxy, mercapto or a derivative of these; and n denotes an integer of 1–3. Specific examples thereof may include:

vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysialne, trimethylmethoxysilane, hydroxypropyltrimethoxysilane, phenyltrimethoxysilane, n-hexadecyltrimethoxysilane, and n-octadecyltrimethoxysilane.

The coupling agent, inclusive of the silane coupling agent, may preferably be used in 1–60 wt. parts, more preferably 3–50 wt. parts, per 100 wt. parts of the inorganic fine powder.

An especially preferred class of silane coupling agents may include alkylalkoxysilane coupling agents represented by a formula of:

$$C_nH_{2n+1}—Si—(OC_mH_{2m+1})_3,$$

wherein n is an integer of 4–12, and m is an integer of 1–3. If n is below n, the treatment is facilitated but the resultant hydrophobicity is liable to be low. If n larger than 12, a sufficient hydrophobicity can be attained, but the treated inorganic fine powder is liable to cause agglomerate, thus lowering the flowability-imparting ability. On the other hand, if m is larger than 3, the reactivity of the alkylalkoxy coupling agent is lowered, so that effective hydrophobization becomes difficult. It is further preferred to use an alkylalkoxysilane coupling agent satisfying n=4–8 and m=1–2.

The alkylalkoxysilane coupling agent may also be used suitably in an amount of 1–60 wt. parts, preferably 3–50 wt. parts, per 100 wt. parts of the inorganic fine powder.

The hydrophobization may be performed by using either a single species of hydrophobization agents or plural species of hydrophobization agents. In the latter case, plural species of hydrophobization agents may be used in mixture for a simultaneous treatment or successively for two step treatments.

The flowability-improving agent may preferably be added in 0.01–5 wt. parts, more preferably 0.05–3 wt. parts, per 100 wt. parts of the toner particles.

In the case of using the toner of the present invention for providing a two-component type developer, the toner may be used in combination with a carrier, examples of which may include surface-oxidized or -unoxidized particles of metals, such as iron, nickel, copper, zinc, cobalt, manganese, chromium and rare earth metals, alloys of these metals, or oxides or ferrites of these metals.

It is particularly preferred to use particles of Mn—Mg—Fe magnetic ferrite principally comprising three elements of manganese, magnesium and iron. It is further preferred that the Mn—Mg—Fe ternary ferrite particles contain 0.001–1 wt. %, more preferably 0.005–0.5 wt. %, of silicone, when the magnetic ferrite particles are coated with a silicone resin.

Thus, magnetic carrier particles may preferably be coated with a resin, particularly a silicone resin. It is particularly preferred to use a nitrogen-containing silicone resin or a modified silicone resin formed by reaction between a nitrogen-containing silane coupling agent and a silicone resin, in view of the performance of imparting negative charge to the toner of the present invention, environmental stability and resistance to carrier surface soiling.

The magnetic carrier particles may preferably have an average particle size of 15–60 $\mu$m, more preferably 25–50 $\mu$m, in relation to the weight-average particle size of the toner.

The average particle size and particle size distribution of magnetic carrier particles may be measured by using a laser diffraction-type particle size distribution meter ("HELOS", available from Nippon Denshi K.K.) equipped with a dry dispersion unit ("RODOS", available from Nippon Denshi K.K.) under conditions of: a lens focal distance of 200 mm, a dispersion pressure of 3.0 bar and a measurement time of 1–2 sec. for a particle size range of 0.5 $\mu$m to 350 $\mu$m divided into 31 channels of which respective particle size ranges are shown in Table 1 below. From the obtained volume-basis distribution, a median particle size ($Dv_{50}$) giving an accumulative 50% by volume is determined as an average particle size, and percentages by volume of respective particle size ranges are determined based on the volume-basis frequency distribution.

TABLE 1

| Range ($\mu$m) | Range ($\mu$m) | Range ($\mu$m) | Range ($\mu$m) |
|---|---|---|---|
| 0.5–1.8 | 6.2–7.4 | 25.0–30.0 | 102.0–122.0 |
| 1.8–2.2 | 7.4–8.6 | 30.0–36.0 | 122.0–146.0 |
| 2.2–2.6 | 8.6–10.0 | 36.0–42.0 | 146.0–174.0 |
| 2.6–3.0 | 10.0–12.0 | 42.0–50.0 | 174.0–206.0 |
| 3.0–3.6 | 12.0–15.0 | 50.0–60.0 | 206.0–246.0 |
| 3.6–4.4 | 15.0–18.0 | 60.0–72.0 | 246.0–294.0 |
| 4.4–5.2 | 18.0–21.0 | 72.0–86.0 | 294.0–350.0 |
| 5.2–6.2 | 21.0–25.0 | 86.0–102.0 | |

*Each range includes the lower limit and not the upper limit.

The laser diffraction-type particle size distribution meter ("HELOS") used in the above measurement is based on the principle of Fraunhofer's diffraction, wherein sample particles are irradiated with a laser beam from a laser source to form diffraction images on a focal plane of a lens disposed on an opposite side with respect to the laser source, and the diffraction images are detected by a detector and processed to calculate a particle size distribution of the sample particles.

The average particle size and particle size distribution of magnetic carrier particles may be adjusted by classification with seives. In order to effect the classification at a particularly good accuracy, it is preferred to effect the classification several time by using sieves with appropriate opening sizes. It is also effective to use sieves of which the opening sizes have been controlled by plating.

In the case of preparing a two-component developer by blending with a color toner, good results are generally obtained if the blending is performed so as to provide a toner concentration of 2–15 wt. %, preferably 4–13 wt. %. At a toner concentration below 2 wt. %, the image density is liable to be lower, and at above 15 wt. %, fog and toner scattering in the apparatus are liable to occur.

Next, an embodiment of the full-color image forming method using the toner of the present invention will now be described with reference to FIG. 1.

FIG. 1 illustrates an embodiment of image forming apparatus for forming full-color images according to electrophotography. The apparatus may be used as a full-color copying apparatus or a full-color printer.

In the case of a full-color copying apparatus, the apparatus includes a digital color image reader unit 35 at an upper part and a digital color image printer unit 36 at a lower part as shown in FIG. 1.

Referring further to FIG. 1, in the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not show) and is transmitted to and treated with a video-treating unit (not shown) to be outputted toward the digital image printer unit.

In the image printer unit, a photosensitive drum 1 as an electrostatic image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system (3*a*, 3*b*, 3*c*), a potential sensor 12, four developing devices containing developers different in color (4Y, 4C, 4M, 4B), a luminous energy (amount of light) detection means 13, a transfer device 5, and a cleaning device 6 are disposed.

In the laser exposure optical system 3, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing device to form a toner image on the photosensitive drum 1. Each of the developing devices 4Y, 4C, 4M and 4B performs development by the action of each of eccentric cams 24Y, 24C, 24M and 24B so as to selectively approach the photosensitive drum 1 depending on the corresponding separated color.

The transfer device 5 includes a transfer drum 5*a*, a transfer charger 5*b*, an adsorption charger 5*c* for electrostatically adsorbing a transfer material, an adsorption roller 5*g* opposite to the adsorption charge 5*c* an inner charger 5*d*, an outer charger 5*e*, and a separation charger 5*h*. The transfer drum 5*a* is rotatably supported by a shaft and has a peripheral surface including an opening region at which a transfer sheet 5*f* as a transfer material-carrying member for carrying the recording material is integrally adjusted. The transfer sheet 5*f* may include resin film, such as a polycarbonate film.

A transfer material is conveyed from any one of cassettes 7*a*, 7*b* and 7*c* to the transfer drum 5*a* via a transfer material-conveying system, and is held on the transfer drum 5*a*. The transfer material carried on the transfer drum 5*a* is repeatedly conveyed to a transfer position opposite to the photosensitive drum 1 in accordance with the rotation of the transfer drum 5*a*. The toner image on the photosensitive drum 1 is transferred onto the transfer material by the action of the transfer charger 5*b* at the transfer position.

A toner image on the photosensitive member 1 may be directly transferred onto a transfer material as in the embodiment of FIG. 1, or alternatively once transferred onto an intermediate transfer member (not shown) and then to the transfer material.

The above image formation steps are repeated with respect to yellow (Y), magenta (M), cyan (C) and black (B) to form a color image comprising superposed four color toner images on the transfer material carried on the transfer drum 5.

The transfer material thus subjected to transfer of the toner image (including four color images) is separated from the transfer drum 5 by the action of a separation claw 8*a*, a separation and pressing roller 8*b* and the separation charger 5*h* to be conveyed to heat-pressure fixation device, where the full-color image carried on the transfer material is fixed under heating and pressure to effect color-mixing and color development of the toner and fixation of the toner onto the transfer material to form a full-color fixed image (fixed full-color image), followed by discharge thereof into a tray 10. As described above, a full-color copying operation for one sheet of recording material is completed.

In the full-color image operation, the fixing operation in the heat-pressure fixing device is performed at a process speed (e.g., 90 mm/sec) smaller than a process speed or a developing speed (e.g., 160 mm/sec) on the photosensitive drum 1. Such a smaller fixing speed than the developing speed is adopted so as to supply an ample heat for melt-mixing the superposed two to four-layer superposed yet-unfixed toner layers.

Figure 2:
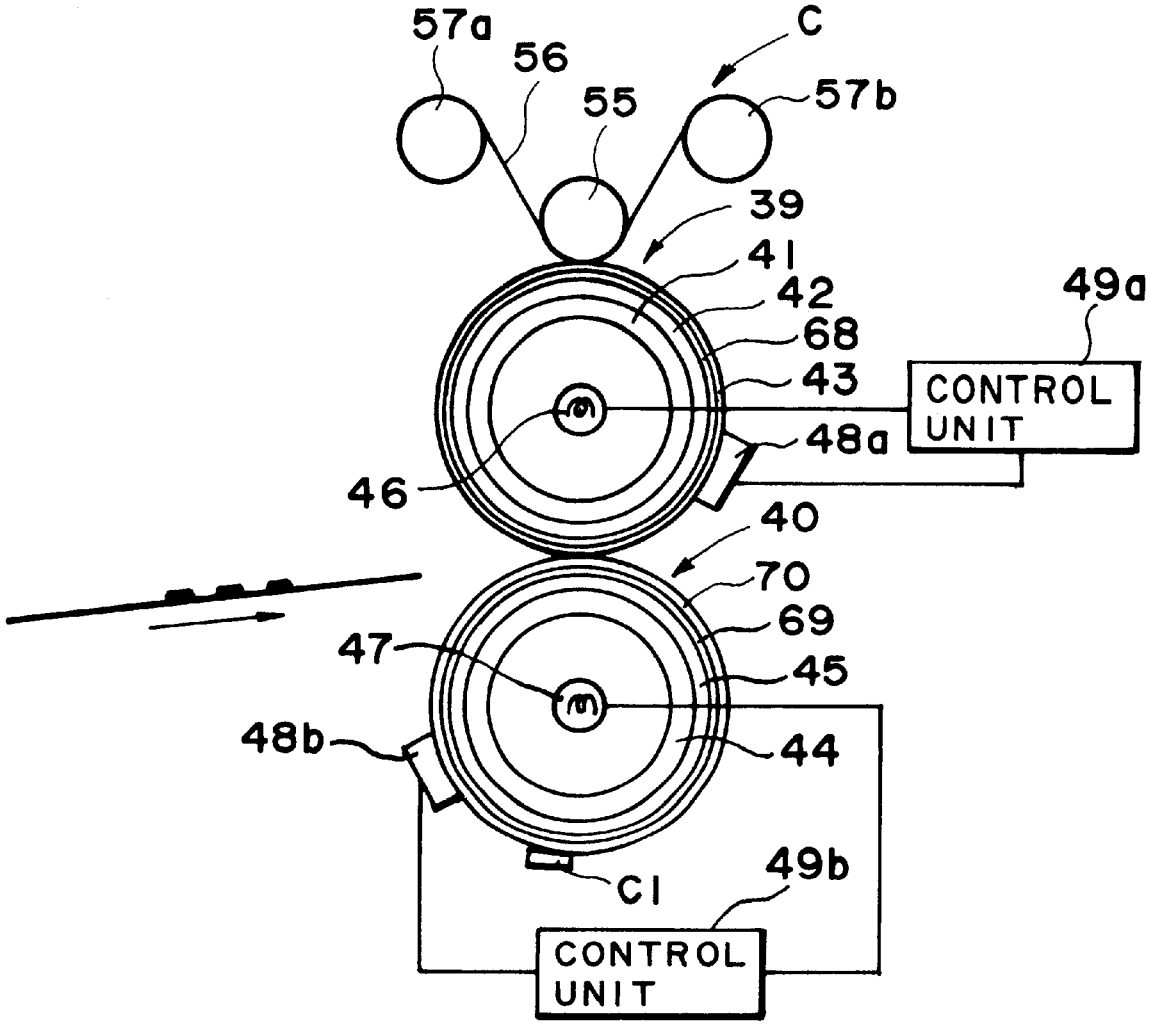
FIG. 2 is a schematic sectional illustration of a heat-pressure fixing means.

FIG. 2 is a schematic sectional view for illustrating an organization of such a heat-pressure fixing device. Referring to FIG. 2, the fixing device includes a fixing roller 39 as a fixing means, which comprises an e.g., 5 mm-thick aluminum metal cylinder 41, and the cylinder 41 is coated with a 3 mm-thick RTV (room temperature-vulcanized) silicone rubber layer 42 (having a JIS-A hardness of 20 deg.) and further with a 50 pm-thick polytetrafluoroethylene (PTFE) layer 43. On the other hand, a pressure roller 40 as a pressure means comprises an e.g., 5 mm-thick aluminum-made metal cylinder 44, which is coated with a 2 mm-thick RTV silicone rubber layer 55 (JIS-A hardness of 40 deg.) and then with a 150 $\mu$m-thick PTFE layer.

In the embodiment of FIG. 2, the fixing roller 39 and the pressure roller 40 both have a diameter of 60 mm. As the pressure roller 40 has a higher hardness, however, a blank transfer paper carrying no toner image is discharged in a direction which is somewhat deviated toward the pressure roller 40 from a line perpendicular to a line connecting the axes of these two rollers. The deviation of the discharge direction toward the pressure roller side is very important for obviating clinping or winding about the fixing roller of a transfer or recording paper for carrying a large-area copy image to be fixed thereon. The deviation of the paper discharge direction may be effected not only by utilizing the above-mentioned hardness difference but also by using a pressure roller having a smaller diameter than the fixing roller or by using a pressure roller set at a higher temperature than the fixing roller so as to preferentially vaporize the moisture from the back (i.e., the pressure roller side) of the fixing paper, thereby causing a slight paper shrinkage.

The fixing roller 39 is provided with a halogen heater 46 as a heating means, and the pressure roller 40 is also provided with a halogen heater 47, so as to allow heating of a fixing paper from both sides. The temperatures of the fixing roller 39 and the pressure roller 40 are detected by thermistors 48*a* and 48*b* abutted against the fixing and pressure rollers 39 and 40, respectively, and the energization of the halogen heaters 46 and 47 is controlled based on the detected temperatures, whereby the temperatures of the fixing roller 39 and the pressure roller 40 are both controlled at constant temperatures (e.g., 160° C. +10° C.) by controllers 49*a* and 49*b*, respectively. The fixing roller 39 and the pressure roller 40 are pressed against each other at a total force of 390N (40 kg.f) by a pressure application mechanism (not shown).

The fixing device also incudes a fixing roller cleaning device C equipped with oil-impregnated web, and also a cleaning blade Cl for removing oil and soil attached to the pressure roller 40. A paper or unwoven cloth web 56 is impregnated with a silicone oil having a viscosity of 50–3000 cSt, such as dimethylsilicone oil or diphenylsilicone oil, which is preferred so as to allow a constant oil supply at a small rate and provide high-quality fixed images with uniform gloss and free from oil trace. In the case of no oil application, the cleaning device C may be removed or operated by using a paper or cloth web 56 not impregnated with oil, or may be replaced by a cleaning blade, a cleaning pad or a cleaning roller.

In a specific example, the cleaning device C was equipped with a web 46 of non-woven cloth pressed against the fixing roller 39 while the web 46 was fed little by little from a feed roll 57*a* to a take-up roller 57*b* so as to prevent the accumulation of waste toner, etc.

As the toner of the present invention is excellent in low-temperature fixability and anti-high-temperature offset characteristic, the application amount of the release agent, such as silicone oil, can be reduced and the cleaning device C is less liable to be soiled.

A toner image formed of the toner according to the present invention may suitably be fixed under pressure at a fixing roller surface temperature of 150° C. while applying substantially no oil or silicone oil at a rate of at most $1\times10^{-7}$ g/cm$^2$ of recording material (transfer material) surface area from the fixing member onto the toner image fixing surface of the recording material.

If the application amount exceeds $1\times10^{-7}$ g/cm$^2$, the fixed image on the recording material is liable to glitter, thus lowering the recognizability of character images.

Figure 3:
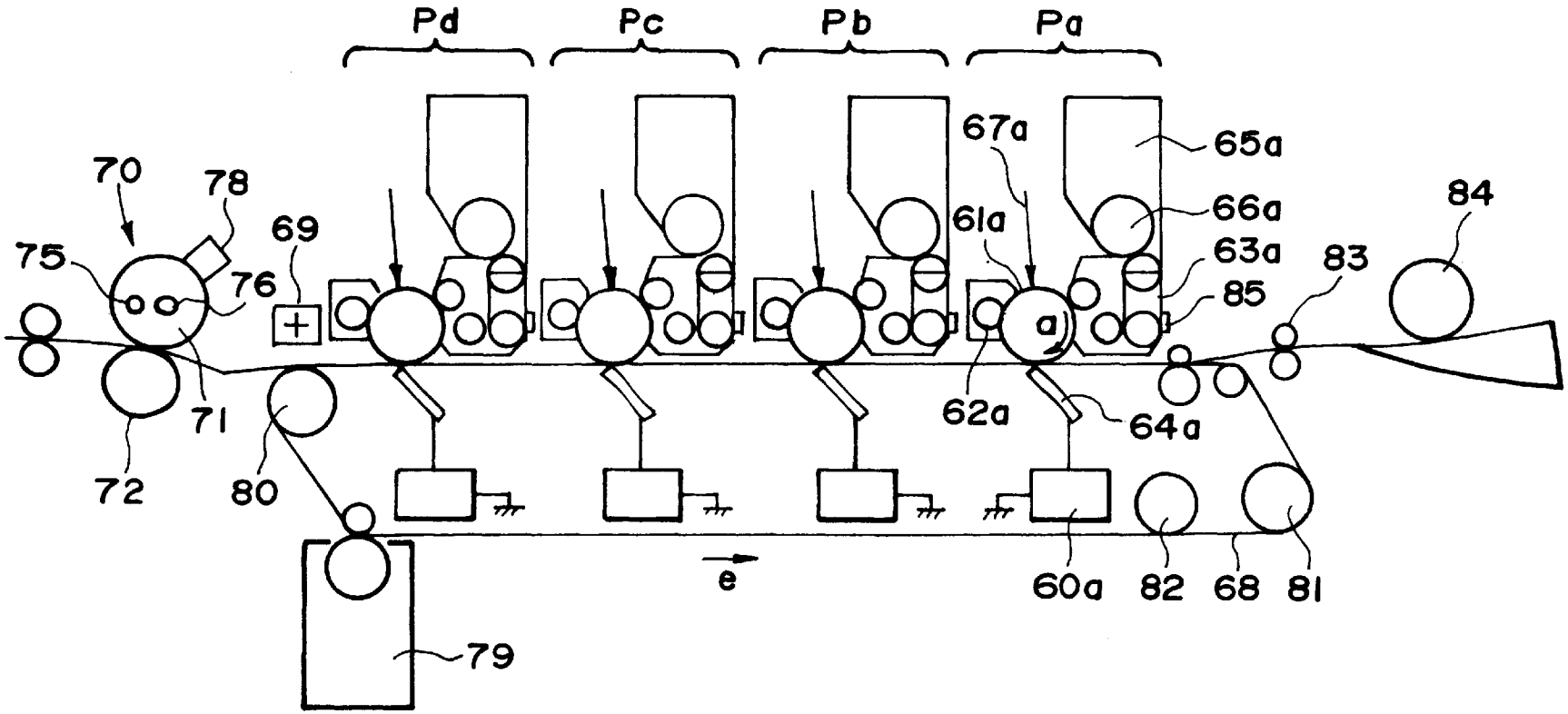
FIG. 3 is a schematic sectional view of another example of full-color image forming apparatus suitable for using the toner of the present invention.

FIG. 3 illustrates a full-color image forming system suitable for practicing another embodiment of the image forming method according to the present invention.

Referring to FIG. 3, a full-color image forming apparatus main body includes a first image forming unit Pa, a second image forming unit Pb, a third image forming unit Pc and a fourth image forming unit Pd disposed in juxtaposition for forming respectively images of difference colors each formed through a process including electrostatic image formation, development and transfer steps on a transfer material.

The organization of the image forming units juxtaposed in the image forming apparatus will now be described with reference to the first image forming unit Pa, for example.

The first image forming unit Pa includes an electrophotographic photosensitive drum 61*a* of 30 mm in diameter as an electrostatic image-bearing member, which rotates in an indicated arrow a direction. A primary charger 62*a* as a charging means includes a 16 mm-dia. sleeve on which a magnetic brush is formed so as to contact the surface of the photosensitive drum 61*a*. The photosensitive drum 61*a* uniformly surface-charged by the primary charger 62*a* is illuminated with laser light 67*a* from an exposure means (not shown) to form an electrostatic image on the photosensitive drum 61*a*. A developing device 63*a* containing a color toner is disposed so as to develop the electrostatic image on the photosensitive drum 61*a* to form a color toner image thereon. A transfer blade 64*a* is disposed as a transfer means opposite to the photosensitive drum 61*a* for transferring a color toner image formed on the photosensitive drum 61*a* onto a surface of a transfer material (recording material) conveyed by a belt-form transfer material-carrying member 68, the transfer blade 64*a* is abutted against a back surface of the transfer material carrying member 68 to supply a transfer bias voltage thereto.

In operation of the first image forming unit Pa, the photosensitive drum 61*a* is uniformly primarily surface-charged by the primary charger 62*a* and then exposed to laser light 67*a* to form an electrostatic image thereon, which is then developed by means of the developing device 6*a* to form a color toner image. Then, the toner image on the photosensitive drum 61*a* is moved to a first transfer position where the photosensitive drum 61*a* and a transfer material abut to each other and the toner image is transferred onto the transfer material conveyed by and carried on the belt-form transfer material-carrying member 68 under the action of a transfer bias electric field applied from the transfer blade 64*a* abutted against the back-side of the transfer material-carrying member 68.

When the toner is consumed on continuation of the development to lower the T/C ratio (in the case of a two-component developer) or provide a lower toner level (in the case of a mono-component developer), the lowering is detected by a toner concentration or toner level detection sensor 85 including, e.g., an inductance coil (not shown) for detecting a change in permeability of the developer, whereby an amount of replenishing toner 65*a* is supplied corresponding to the amount of consumed toner.

The image forming apparatus includes the second image forming unit Pb, the third image forming unit Pc and the fourth image forming unit Pd each of which has an identical organization as the above-described first image forming unit Pa but contains a toner of a different color, in juxtaposition with the first image forming unit Pa. For example, the first to fourth units Pa to Pd contain a yellow toner, a magenta toner a cyan toner and a black toner, respectively, and at the transfer position of each image forming unit, the transfer of toner image of each color is sequentially performed onto an identical transfer material while moving the transfer material once for each color toner image transfer and taking a registration of the respective color toner images, whereby superposed color images are formed on the transfer material. After forming superposed toner images of four colors on a transfer material, the transfer material is separated from the transfer material-carrying member 68 by means of a separation charger 69 and sent by a conveyer means like a transfer belt to a fixing device 70 where the superposed color toner images are fixed onto the transfer material in a single fixation step to form an objective full-color image.

The fixing device 70 includes, e.g., a pair of a 40 mm-dia. fixing roller 71 and a 30 mm-dia. pressure roller 72. The fixing roller 71 includes internal heating means 75 and 76. Yet unfixed color-toner images on a transfer material are fixed onto the transfer material under the action of heat and pressure while being passed through a pressing position between the fixing roller 71 and the pressure roller 72 of the fixing device 70.

In the apparatus shown in FIG. 3, the transfer material-carrying member 68 is an endless belt member and is moved in the direction of an indicated arrow e direction by a drive roller 80 and a follower roller 81. During the movement, the transfer belt 68 is subjected to operation of a transfer belt cleaning device 79 and a belt discharger. In synchronism with the movement of the transfer belt 68, transfer materials are sent out by a supply roller 84 and moved under the control of a pair of registration roller 83.

By using the image forming systems shown in FIGS. 1 and 3, for example, a color toner image comprising at least a toner according to the present invention is formed on a recording material (i.e., transfer material) sheet in a fixed state to provide a color image.

Various properties characterizing the toner of the present invention described herein are based or values measured according to the following methods.

(1) Viscoelasticity

A sample toner is molded under pressure a disk of 25 mm in diameter and ca. 2–3 mm in thickness. The disk sample is placed in a holder of parallel plates each in a diameter of 25 mm and subjected to measurement in a temperature range of 50–200° C. under a temperature-raising rate of 2° C./min by using a visco-elasticity measurement apparatus ("Rheometer RDA-II", available from Rheometrics Co) according to the automatic measurement mode under the conditions including a measurement strain initial set value of 0.01% and fixed angular frequency (w) of 6.28 rad/sec. The measured values of storage modulus (G') and loss modulus (G") are taken on the ordinate versus the temperatures taken on the abscissa to read the respective values at relevant temperatures.

(2) Differential Scanning Calorimetry

Measurement may be performed in the following manner by using a differential scanning calorimeter ("DSC-7", available from Perkin-Elmer Corp.) according to ASTM D3418-82.

A sample in an amount of 2–10 mg, preferably about 5 mg, is accurately weighed. The sample is placed on an aluminum pan and subjected to measurement in a temperature range of 30–200° C. at a temperature-raising or -lowering rate of 10° C./min in a normal temperature—normal humidity environment in parallel with a blank aluminum pan as a reference.

In the course of temperature increase or decrease, a main absorption or evolution peak appears at a temperature (Tabs.max or Tevo.max) in the range of 30–200° C. on a DSC curve. In the case of plural peaks, the temperature of the largest peak is taken as Tabs.max or Tevo.max.

(3) Molecular Weight Distribution by GPC

A sample toner is dissolved in THF and subjected to 6 hours of extraction with THF under refluxing by a Soxhlets extractor to form a GPC sample.

In the GPC apparatus, a column is stabilized in a heat chamber at 40° C., tetrahydrofuran (THF) solvent is caused to flow through the column at that temperature at a rate of 1 ml/min., and ca. 50–200 $\mu$l of a GPC sample solution adjusted at a resin concentration of 0.05–0.6 wt. % is injected.

The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; or a combination of Shodex KA-801, 802, 803, 804, 805, 806 and 807 available from Showa Denko K.K.

(4) Particle Size Distribution of Toner

Coulter counter Model TA-II or Coulter Multisizer (available from Coulter Electronics Inc.) may be used as an instrument for measurement. For measurement, a 1%-NaCl aqueous solution as an electrolyte solution is prepared by using a reagent-grade sodium chloride (e.g., "Isoton II" (trade name), available from Coulter Scientific Japan Co. may be commercially available). To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 $\mu$m by using the above-mentioned apparatus with a 100 micron-aperture to obtain a volume-bias distribution and a number-basis distribution. From the results of the volume-basis distribution, the weight-average particle size (D4) and volume-average particle size (Dv) of the toner may be obtained (while using a central value for each channel as the representative value of the channel).

The following 13 channels are used: 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m 10.08–12.70 $\mu$m; 12.70–16.00 $\mu$m; 16.00 20.20 $\mu$m; 20.20–25.40 $\mu$m; 25.40–32.00 $\mu$m; 32–40.30 $\mu$m.

(5) Acid Value

A sample in an amount of 2–10 g is weighed into a 200 to 300 ml-Erlenmeyer flask, and ca. 50 ml of a solvent mixture of methanol/toluene (=30/70) is added thereto to dissolve the sample. In case of poor solubility, a small amount of acetone may be added. A mixture indicator of 0.1% Brome Thymol Blue and Phenol red is used for titration of the sample solution with a preliminarily standardized N/10-solution of potassium hydroxide (KOH) in alcohol. Based on the KOH solution used for the titration, the acid value is calculated according to the following equation.

Acid value=KOH (mol)×f×56.1/sample weight, wherein f denotes a factor of N/10—KOH solution.

In case where a toner contains a magnetic material, the magnetic material is removed by dissolution with an acid, and the residue is used as a sample for the above measurement.

Hereinbelow, some specific Examples are raised regarding the production and evaluation of the toner according to the present invention, but these Examples should not be construed to restrict the scope of the present invention.

PRODUCTION EXAMPLE 1 FOR HYBRID RESIN

As starting materials for a vinyl copolymer, 1.9 mol of styrene, 0.21 mol of 2-ethylhexyl acrylate, 0.15 mol of fumaric acid, 0.03 mol of $\alpha$-methylstyrene dimer and 0.05 mol of dicumyl peroxide were placed in a dropping funnel.

Separately, for preparation of a polyester, 7.0 mol of polyoxypropylene(2.2)-2,2-bis(4-hydroxy-phenyl)propane, 3.0 mol of polyoxyethylene(2.2)-2,2-bis(4-hydroxyphenyl) propane, 3.0 mol of succinic acid, 2.0 mol of trimellitic anhydride, 5.0 mol of fumaric acid and 0.2 g of dibutyltin oxide were placed in a glass-made 4 liter four-necked flask, which was then equipped with a thermometer, a stirring bar, a condenser and a nitrogen-intake pipe, and placed on a mantle heater. Then, the interior of the flask was aerated with nitrogen and then the system was gradually heated under stirring. At 145° C., under continued stirring, the starting materials for the vinyl copolymer including the polymerization initiator in the dropping funnel were added dropwise into the system over 4 hours. Then, the system was heated to 200° C. for 4 hours of reaction to obtain Hybrid resin (1). The results of GPC and acid value measurement for Hybrid resin (1) are shown in Table 1 together with those of the resins obtained in the following Production Examples.

PRODUCTION EXAMPLE 2 FOR HYBRID RESIN

Hybrid resin (2) was prepared in the same manner as in Production Example 1 except for changing the amounts of certain ingredients for production of a vinyl copolymer to 3.8 mol for the styrene, 0.07 mol for the $\alpha$-methylstyrene dimer and 0.1 mol for the dicumyl peroxide.

PRODUCTION EXAMPLE 3 FOR HYBRID RESIN

Hybrid resin (3) was prepared in the same manner as in Production Example 1 except for using 4.0 mol of maleic acid and 3.5 mol of itaconic acid instead of the 5.0 mol of fumaric acid for the production of ao polyester unit, and using 0.1 mol of isobutyl peroxide instead of the 0.05 mol of dicumyl peroxide for the production of a vinyl copolymer unit.

PRODUCTION EXAMPLE 4 FOR HYBRID RESIN

Hybrid resin (4) was prepared in the same manner as in Production Example 1 except for using 5.2 mol of trimellitic anhydride instead of the 3.0 mol of terephthalic acid and 2.0 mol of trimellitic anhydride for the production of a polyester unit.

PRODUCTION EXAMPLE 1 FOR POLYESTER RESIN 3.6 mol of polyoxypropylene(2.2)-2,2-bis(4-hydroxyphenyl)propane, 1.6 mol of polyoxyethylene-(2.2)-2,2-bis(4-hydroxyphenyl)propane, 1.7 mol of terephthalic acid, 1.1 mol of trimellitic anhydride, 2.4 mol of fumaric acid and 0.1 g of dibutyltin oxide were placed in a glass-made 4-liter four-necked flask, which was then equipped with a thermometer, a stirring bar, a condenser and a nitrogen-intake pipe and placed on a mantle heater. In a nitrogen atmosphere, the system was subjected to 5 hours of reaction at 215° C. to obtain Polyester resin (1).

PRODUCTION EXAMPLE 2 FOR POLYESTER RESIN

Polyester resin (2) was prepared in the same manner as in Production Example 1 except for changing the monomers to 1.6 mol of polyoxypropylene(2.2)-2,2-bis(4-hydroxyphenyl)propane, 3.3 mol of polyoxyethylene(2.2)-2,2-bis(4-hydroxyphenyl)propane, 1.6 mol of terephthalic acid, 0.3 mol of trimellitic anhydride, and 3.2 mol of fumaric acid.

PRODUCTION EXAMPLE FOR VINYL RESIN (1)

1000 ml of toluene, and as starting materials for a vinyl copolymer, 2.4 mol of styrene, 0.26 mol of n-butyl acrylate, 0.09 mol of monobutyl maleate, and 0.11 mol of di-t-butyl peroxide, were placed in a 3 liter-four-necked flask, which was then equipped with a thermometer, a stainless steel-made stirring bar, a flow down-type condenser and a nitrogen-intake pipe and placed on a mantle heater. Then, in a nitrogen atmosphere, the system was subjected to reaction at 120° C. under toluene refluxing and stirring to obtain Vinyl resin (1).

The properties of the resins obtained in the above Production Examples are inclusively shown in Table 2 below.

TABLE 2

GPC and acid value data of resins

| Resins | GPC Mw ($\times 10^3$) | GPC Mn ($\times 10^3$) | GPC Mp ($\times 10^3$) | GPC Mw/Mn | Acid value (mgKOH/g) |
|---|---|---|---|---|---|
| Polyester (1) | 25.7 | 3.2 | 6.4 | 8.03 | 15.1 |
| Polyester (2) | 4.3 | 2.2 | 3.1 | 1.95 | 28.1 |
| Hybrid (1) | 83.0 | 3.1 | 15.4 | 26.77 | 28.1 |
| Hybrid (2) | 72.1 | 3.2 | 15.1 | 22.53 | 34.5 |
| Hybrid (3) | 108.1 | 4.2 | 30.3 | 25.74 | 36.2 |
| Hybrid (4) | 294.9 | 4.5 | 89.4 | 65.53 | 39.6 |
| Vinyl (1) | 19.0 | 2.7 | 9.1 | 7.04 | 0 |

Waxes (A)–(E) having properties shown in the following Table 3 were used for Examples and Comparative Examples for toner production described hereinafter.

TABLE 3

Waxes

| Name | Tabs.max*1 (° C.) | Type | Mp(–)*3 |
|---|---|---|---|
| (A) | 64.3 | refined n-paraffin | 510 |
| (B) | 72.7 | ester | 640 |
| (C) | 45.0 | paraffin | 300 |
| (D) | 95.7 | polyethylene (PE) | 650 |
| (E) | 108.9 | modified PE*2 | 930 |

*1Maximum heat-absorption peak temperature on a DSC curve.
*2Alcohol-modified polyethylene wax.
*3Main-peak molecular weight according to GPC.

EXAMPLE 1

Cyan toner (1) was prepared in the following manner.

| | |
|---|---|
| Hybrid resin (1) | 100 wt. parts |
| Wax (A) | 4 wt. parts |
| C.I. Pigment Blue 15:3 | 5 wt. parts |
| Di-t-butylsalicylic acid Al complex | 6 wt. parts |

The above ingredients were sufficiently blended by a Henschel mixer and melt-kneaded at 160–170° C. by means of a twin-screw extruder. During the melt-kneading, a gradual increase in viscosity of the melt-kneaded product was observed. After being cooled, the melt-kneaded product was coarsely crushed to ca. 1–2 mm and then finely pulverized by means of an air-jet pulverizer, followed by classification by means of a multi-division classifier to obtain cyan toner particles having a weight-average particle size (D4) of 7.6 $\mu$m.

100 wt. parts of the cyan toner particles prepared above were blended with externally added 1.0 wt. part of hydrophobic aluminum oxide fine powder ($S_{BET}$=170 $m^2/g$) treated with 25 wt. % of i-$C_4H_9Si(OCH_3)_3$ to obtain Cyan toner (1). Some properties and characteristic features of Cyan toner (1) are shown in Table 4 (Tables 4-1 to 4-3) appearing hereinafter together with those of toners prepared in Examples described below.

Cyan toner (1) was further blended with silicone resin-coated magnetic ferrite carrier particles (average particle size ($Dv_{50}$)=50 $\mu$m) so as to provide a toner concentration of 6 wt. %, thereby obtaining Cyan developer (1) of the two-component type.

Cyan developer (1) was incorporated in a color copying machine ("CLC-800" made by Canon K.K.) to form yet-unfixed toner images having an image areal percentage of 20% and a toner coverage of 0.7 mg/$cm^2$ by a single color-mode continuous image forming operation on 10,000 sheets each in three environment of NT/NH (23° C./60%RH), NT/LH (23° C./5%RH) and HT/HH (30° C./80%RH). Mos of the yet-unfixed toner images were fixed to provide fixed images by using a fixing apparatus shown in FIG. 2 from which the roller cleaning device C had been removed at fixing speeds of 90 mm/sec and 100 mm/sec.

Some other yet-unfixed toner images were subjected to various tests as described below including a fixing test in an environment of NT/NH (23° C./60%RH) wherein the fixing temperature was manually changed over a wide range to determine a fixable temperature range by using the above-mentioned cleanerless fixing device.

Based on the above fixing tests, the lowest fixable temperature ($T_{FI}$) and the high-temperature offset initiation temperature ($T_{OFFSET}$) were determined, and from these temperatures, a fixable or non-offset temperature range ($T_{OFFSET}$–$T_{FI}$) was calculated.

(OHP Transparency)

Toner images were fixed on OHP films at a fixing speed of 30 mm/sec and at a fixing temperature lower by 10° C. than the high-temperature offset initiation temperature ($T_{OFFSET}$), and each fixed toner image on an OHP film was subjected to measurement of a transmittance (%) at a wavelength of 500 nm for a cyan toner, 600 nm for a yellow toner or 650 nm for a magenta toner, as a maximum absorption wavelength of each color, by an automatic recording spectrophotometer ("UV 2200", made by Shimadzu Seisakusho K.K.) relative to the transmittance of the OHP blank film per se (as 100%). Based on the measured relative transmittance (%), the evaluation was performed according to the following standard.

A: ≧85%

B: 75–85%

C: 65–75%

D: <65%

(Transferability)

A continuous image formation on 10,000 sheets was performed by using the color copying machine ("CLC-800") equipped with a cleanerless fixing device in an NT/LH (23° C./5%RH) environment. With respect to solid images formed at a initial stage and after the continuous image formation, the toner amount (per unit area) on the photosensitive member and the toner amount transferred onto the transfer material (per unit area) were measured to calculate a transfer rate (%) according to the following formula:

Transfer rate (%)=((Toner amount on the transfer material)/(toner amount on the photosensitive member before the transfer))×100

(Anti-blocking Property)

100 g of a sample toner (blended with an external additive) was placed in a 500 ml-polyethylene vessel and held in an oven at 50° C. (for 1 week). Based on the degree of agglomeration according to eye observation, the evaluation was performed according to the following standard:

A: No agglomerate was observed at all, and the sample exhibited very good flowability.

B: No agglomerate was observed.

C: Some agglomerate was observed but could be disintegrated easily.

D: Agglomerate was formed but could be disintegrated by a developer stirring device.

E: Agglomerate formed was not sufficiently disintegrated by a developer stirring device.

Cyan toner (1) (and accordingly Cyan developer (1)) exhibited good transferability, excellent-fixability and anti-blocking property, provided images with good gloss and transparency for OHP use, and also exhibited good environmental stability. The results of the evaluation are inclusively shown in Table 5 (Tables 5-1 and 5-2) together with those of toners obtained in the following Examples and Comparative Examples.

EXAMPLE 2

Cyan toner (2) and Cyan developer (2) were prepared and evaluated in the same manner as in Example 1 except for using Hybrid resin (2) instead of Hybrid resin (1) and using hydrophobic anatase-form titanium oxide fine particles ($S_{BET}$=100 $m^2/g$) instead of the hydrophobic aluminum oxide fine powder ($S_{BET}$=170 $m^2/g$).

EXAMPLE 3

Cyan toner (3) and Cyan developer (3) were prepared and evaluated in the same manner as in Example 1 except for using a mixture of 50 wt. parts of Polyester resin (1) and 50 wt. parts of Hybrid resin (1) instead of the 100 wt. parts of Hybrid resin (1) and increasing the amount of the di-t-butylsalicylic acid Al complex to 8 wt. parts.

EXAMPLE 4

Cyan toner (4) and Cyan developer (4) were prepared and evaluated in the same manner as in Example 1 except for using Hybrid resin (3) instead of Hybrid resin (1), increasing the amount of the di-t-butylsalicylic acid Al complex to 8 wt. parts, and using hydrophobic silica fine particles ($S_{BET}$=210 $m^2/g$) instead of the hydrophobic aluminum oxide fine powder ($S_{BET}$=170 $m^2/g$).

The toner exhibited slightly lower transferability in a low-humidity environment and resulted in images with somewhat lower gloss and transparency for OHP use, whereas the toner exhibited excellent fixability and anti-blocking property.

EXAMPLE 5

Cyan toner (5) and Cyan developer (5) were prepared and evaluated in the same manner as in Example 1 except for using Wax (B) instead of Wax (A).

EXAMPLE 6

Cyan toner (6) and Cyan developer (6) were prepared and evaluated in the same manner as in Example 1 except for reducing the amount of the di-t-butylsalicylic acid Al complex to 2 wt. parts.

The toner exhibited somewhat lower anti-blocking property but exhibited good performances in other respects.

EXAMPLE 7

Cyan toner (7) and Cyan developer (7) were prepared and evaluated in the same manner as in Example 1 except for reducing the amount of the di-t-butylsalicylic acid Al complex to 3 wt. parts and using Wax (D) instead of Wax (A).

Because of a high-crystallinity and high melting point of the wax used, the toner resulted in images with somewhat lower transparency for OHP use and low-temperature fixability presumably because the exudation of the wax to the fixed image was somewhat retarded, but the results were judged to be relatively good. The toner exhibited good transferability, anti-blocking property and environmental stability.

EXAMPLE 8

Cyan toner (8) and Cyan developer (8) were prepared and evaluated in the same manner as in Example 1 except for reducing the amount of the di-t-butylsalicylic acid Al complex to 3 wt. parts and using Wax (E) instead of Wax (A).

Because of a high-crystallinity and high melting point of the wax used, the toner resulted in images with somewhat lower transparency for OHP use and low-temperature fixability presumably because the exudation of the wax to the fixed image was somewhat retarded, but the results were generally judged to be relatively good. The toner exhibited good transferability, anti-blocking property and environmental stability.

EXAMPLE 9

Magenta toner (1) and Magenta developer (1) were prepared and evaluated in the same manner as in Example 1 except for using 6 wt. parts of C.I. Pigment Red 202 instead of the 5 wt. parts of C.I. Pigment Blue 15:3.

EXAMPLE 10

Yellow toner (1) and Yellow developer (1) were prepared and evaluated in the same manner as in Example 1 except for using 4 wt. parts of C.I. Pigment Yellow 17 instead of the 5 wt. parts of C.I. Pigment Blue 15:3.

EXAMPLE 11

Black toner (1) and Black developer (1) were prepared and evaluated in the same manner as in Example 1 except for using 3 wt. parts of carbon black instead of the 5 wt. parts of C.I. Pigment Blue 15:3.

EXAMPLE 12

Cyan toner (9) and Cyan developer (9) were prepared and evaluated in the same manner as in Example 1 except for obtaining cyan toner particles of D4=4.1 μm by changing the classification condition and increasing the amount of the hydrophobic aluminum oxide fine powder ($S_{BET}$=170 $m^2/g$) to 1.8 wt. parts for blending with the cyan toner particles.

The toner exhibited a somewhat lower transfer rate after the continuous image formation but exhibited good performances in other respects.

EXAMPLE 13

Cyan toner (10) and Cyan developer (10) were prepared and evaluated in the same manner as in Example 1 except for obtaining cyan toner particles of D4=9.9 μm by changing the classification condition and decreasing the amount of the hydrophobic aluminum oxide fine powder ($S_{BET}$=170 $m^2/g$) to 0.8 wt. part for blending with the cyan toner particles.

The toner exhibited a somewhat inferior thin-line reproducibility because of a larger toner particle size but exhibited good performances in other respects.

EXAMPLE 14

Cyan toner (11) and Cyan developer (11) were prepared and evaluated in the same manner as in Example 1 except for 6 wt. parts of di-t-butylsalicylic acid Zn complex instead of the 6 wt. parts of di-t-butylsalicylic acid.

The toner exhibited somewhat lower image density and transferability after the continuous image formation, and somewhat inferior anti-blocking property, but the performances were judged to be relatively good as a whole.

EXAMPLE 15

Four color developers comprising Cyan developer (1) of Example 1, Magenta developer (1) of Example 9, Yellow developer (1) of Example 10 and Black developer (1) of Example 11, were charged in a full-color copying machine ("CLC 800", made by Canon K.K.) after remodeling for removal of the oil-application mechanism from the fixing device, and subjected to a continuous full-color image formation test on 10,000 sheets, whereby copy images excellent in color mixability and with broad color reproducibility were obtained without causing offset.

The thus-formed full-color images exhibited good gloss, produced OHP transparency showing good transmittance and exhibited broad non-offset temperature ranges on both plain paper and OHP films.

COMPARATIVE EXAMPLE 1

Comparative Cyan toner (A) and Comparative Cyan developer (A) were prepared and evaluated in the same manner as in Example 1 except for using Hybrid resin (4) instead of Hybrid resin (1) and increasing the amount of the di-t-butylsalicylic acid Al complex to 7.5 wt. parts.

Because of a large Mp of the resin, Comparative Cyan toner (A) became a very hard toner, thus having resulted in images showing lower gloss and transparency for OHP use and also inferior low-temperature fixability presumably due to retardation of wax exudation to the toner surface at the time of fixation. Further, as the content of the organometallic compound was large, the toner failed in providing a sufficient image density in a low-humidity environment, presumably due to excessive charge.

COMPARATIVE EXAMPLE 2

Comparative Cyan toner (B) and Comparative Cyan developer (B) were prepared and evaluated in the same manner as in Example 1 except for using Polyester resin (2) instead of Hybrid resin (1) and decreasing the amount of the di-t-butylsalicylic acid Al complex to 4 wt. parts.

Because of a small Mp of the resin, Comparative Cyan toner became a very soft toner, thus exhibiting inferior anti-blocking property and anti-high-temperature offset property.

COMPARATIVE EXAMPLE 3

Comparative Cyan toner (C) and Comparative Cyan developer (C) were prepared and evaluated in the same manner as in Example 1 except for using Vinyl resin (1) instead of Hybrid resin (1) and increasing the amount of the di-t-butylsalicylic acid Al complex to 7.5 wt. parts.

The toner resulted in images with lower gloss and transparency for OHP use and also exhibited somewhat inferior anti-blocking property.

COMPARATIVE EXAMPLE 4

Comparative Cyan toner (D) and Comparative Cyan developer (D) were prepared and evaluated in the same manner as in Example 1 except for using Polyester resin (1) instead of Hybrid resin (1) and increasing the amount of the di-t-butylsalicylic acid Al complex to 12 wt. parts.

Comparative Cyan toner (D) became a very hard toner, thus having resulted in images showing lower gloss and transparency for OHP use and also inferior low-temperature fixability presumably due to retardation of wax exudation to the toner surface at the time of fixation. Further, as the content of the organometallic compound was large, the toner failed in providing a sufficient image density in a low-humidity environment, presumably due to excessive charge.

COMPARATIVE EXAMPLE 5

Comparative Cyan toner (E) and Comparative Cyan developer (E) were prepared and evaluated in the same manner as in Example 1 except for omitting the di-t-butylsalicylic acid Al complex.

Cyan toner (E) failed to exhibit satisfactory chargeability, fixability and viscoelasticity.

COMPARATIVE EXAMPLE 6

Comparative Cyan toner (F) and Comparative Cyan developer (F) were prepared and evaluated in the same manner as in Example 1 except for using Wax (C) (low-melting point paraffin wax) instead of Wax (A) (refined n-paraffin wax).

Since a point of time after continuously forming images on ca. 1,000 sheets, fog and toner scattering became noticeable, so that the continuous image formation was terminated. Further, the exhibited inferior flowability and also inferior transferability from the initial stage. This was presumably because the toner contained a low-melting point wax which deteriorated chargeability, heat resistance and anti-blocking property and also resulted in a toner with insufficient fixing performances.

COMPARATIVE EXAMPLE 7

Comparative Magenta toner (A) and Comparative Magenta developer (A) were prepared and evaluated in the same manner as in Comparative Example 1 except for using 6 wt. parts of C.I. Pigment Red 202 instead of the 5 wt. parts of C.I. Pigment Blue 15:3.

COMPARATIVE EXAMPLE 8

Comparative Yellow toner (A) and Comparative Yellow developer (A) were prepared and evaluated in the same manner as in Comparative Example 1 except for using 4 wt. parts of C.I. Pigment Yellow 17 instead of the 5 wt. parts of C.I. Pigment Blue 15:3.

COMPARATIVE EXAMPLE 9

Comparative Black toner (A) and Comparative Black developer (A) were prepared and evaluated in the same manner as in Comparative Example 1 except for using 3 wt. parts of carbon black instead of the 5 wt. parts of C.I. Pigment Blue 15:3.

COMPARATIVE EXAMPLE 10

Four color developers comprising Comparative Cyan developer (A) of Comparative Example 1, Comparative Magenta developer (A) of Comparative Example 7, Comparative Yellow developer (A) of Comparative Example 8 and Comparative Black developer (A) of Comparative Example 9, were subjected to a continuous full-color image formation test in the same manner as in Example 15.

Compared with the operation in Example 15, offset was liable to occur, and the non-offset temperature range was narrower. Further, the thus formed full-color images on plain paper exhibited fluctuation in gloss, and the full-color images on OHP films exhibited lower transparency.

TABLE 4-1

| | Toner (Composition) | | | | |
|---|---|---|---|---|---|
| Example | Toner | Resin | Organometallic compound Metal/wt. parts | Wax | External additive |
| 1 | Cyan (1) | Hybrid (1) | Al/6 | (A) | $Al_2O_3$ |
| 2 | Cyan (2) | Hybrid (2) | ↑ | ↑ | $TiO_2$ |
| 3 | Cyan (3) | Polyester (1)/Vinyl (1) | Al/8 | ↑ | $Al_2O_3$ |
| 4 | Cyan (4) | Hybrid (3) | ↑ | ↑ | $SiO_2$ |
| 5 | Cyan (5) | Hybrid (1) | Al/6 | (B) | $Al_2O_3$ |
| 6 | Cyan (6) | ↑ | Al/2 | (A) | ↑ |
| 7 | Cyan (7) | Hybrid (2) | Al/3 | (D) | ↑ |
| 8 | Cyan (8) | ↑ | ↑ | (E) | ↑ |
| 9 | Magenta (1) | Hybrid (1) | Al/6 | (A) | ↑ |
| 10 | Yellow (1) | Hybrid (1) | ↑ | ↑ | ↑ |
| 11 | Black (1) | Hybrid (1) | ↑ | ↑ | ↑ |
| 12 | Cyan (9) | ↑ | ↑ | ↑ | ↑ |
| 13 | Cyan (10) | ↑ | ↑ | ↑ | ↑ |
| 14 | Cyan (11) | ↑ | Zn/6 | ↑ | ↑ |
| Comp. 1 | Cyan (A) | Hybrid (4) | Al/7.5 | ↑ | ↑ |
| Comp. 2 | Cyan (B) | Polyester (2) | Al/4 | ↑ | ↑ |
| Comp. 3 | Cyan (C) | Vinyl (1) | Al/7.5 | ↑ | ↑ |
| Comp. 4 | Cyan (D) | Polyester (1) | Al/12 | ↑ | ↑ |
| Comp. 5 | Cyan (E) | ↑ | none | ↑ | ↑ |
| Comp. 6 | Cyan (F) | ↑ | Al/6 | (C) | ↑ |
| Comp. 7 | Magenta (A) | Hybrid (4) | Al/7.5 | (A) | ↑ |
| Comp. 8 | Yellow (A) | ↑ | ↑ | ↑ | ↑ |
| Comp. 9 | Black (A) | ↑ | ↑ | ↑ | ↑ |

TABLE 4-2

| | Toner (Viscoelasticity) | | | | | | | | |
|---|---|---|---|---|---|---|---|---|---|
| | | Storage modulus (G') | | | | | | | |
| | | | | 120–180° C. | | | | | |
| Example | Toner | at 80° C. | at 120° C. | min (G' min) | max (G' max) | 120–180° C. G' max/G' min | $\tan\delta_{min}$ | $\tan\delta_{180}$ | $\tan\delta_{180}/\tan\delta_{min}$ |
| 1 | Cyan (1) | $5.2 \times 10^6$ | $7.8 \times 10^4$ | $3.4 \times 10^4$ | $1.3 \times 10^5$ | 3.8 | 0.73 | 1.10 | 1.51 |
| 2 | Cyan (2) | $5.9 \times 10^6$ | $3.1 \times 10^5$ | $2.1 \times 10^5$ | $4.2 \times 10^5$ | 2.0 | 0.51 | 0.73 | 1.43 |
| 3 | Cyan (3) | $4.5 \times 10^6$ | $8.5 \times 10^4$ | $4.7 \times 10^4$ | $2.1 \times 10^5$ | 4.5 | 0.20 | 0.52 | 2.60 |
| 4 | Cyan (4) | $1.1 \times 10^8$ | $5.0 \times 10^5$ | $3.3 \times 10^5$ | $8.7 \times 10^5$ | 2.6 | 0.83 | 1.21 | 1.46 |
| 5 | Cyan (5) | $7.1 \times 10^6$ | $2.2 \times 10^4$ | $1.1 \times 10^4$ | $4.2 \times 10^4$ | 3.8 | 0.78 | 1.21 | 1.55 |
| 6 | Cyan (6) | $2.2 \times 10^6$ | $7.7 \times 10^3$ | $6.5 \times 10^3$ | $9.9 \times 10^3$ | 1.5 | 0.66 | 0.71 | 1.08 |
| 7 | Cyan (7) | $6.5 \times 10^7$ | $5.4 \times 10^5$ | $3.4 \times 10^5$ | $7.2 \times 10^5$ | 2.1 | 0.85 | 1.18 | 1.39 |
| 8 | Cyan (8) | $8.3 \times 10^7$ | $7.3 \times 10^5$ | $6.8 \times 10^5$ | $8.8 \times 10^5$ | 1.3 | 0.89 | 1.14 | 1.28 |
| 9 | Magenta (1) | $4.7 \times 10^6$ | $7.1 \times 10^4$ | $3.0 \times 10^4$ | $1.4 \times 10^5$ | 4.7 | 0.71 | 1.18 | 1.66 |
| 10 | Yellow (1) | $5.5 \times 10^6$ | $6.8 \times 10^4$ | $3.1 \times 10^4$ | $1.5 \times 10^5$ | 4.8 | 0.76 | 1.11 | 1.46 |
| 11 | Black (1) | $5.1 \times 10^6$ | $7.3 \times 10^4$ | $3.5 \times 10^4$ | $1.4 \times 10^5$ | 4.0 | 0.72 | 1.14 | 1.58 |
| 12 | Cyan (9) | $5.2 \times 10^6$ | $7.6 \times 10^4$ | $3.4 \times 10^4$ | $1.3 \times 10^5$ | 3.8 | 0.71 | 1.15 | 1.62 |
| 13 | Cyan (10) | $5.2 \times 10^6$ | $7.8 \times 10^4$ | $3.4 \times 10^4$ | $1.3 \times 10^5$ | 3.8 | 0.74 | 1.17 | 1.58 |
| 14 | Cyan (11) | $4.5 \times 10^6$ | $6.1 \times 10^4$ | $1.1 \times 10^4$ | $2.1 \times 10^5$ | 19.1 | 0.67 | 1.07 | 1.60 |
| Comp. 1 | Cyan (A) | $2.5 \times 10^{10}$ | $4.5 \times 10^7$ | $2.2 \times 10^7$ | $5.8 \times 10^8$ | 26.4 | 0.81 | 1.01 | 1.25 |
| Comp. 2 | Cyan (B) | $2.1 \times 10^6$ | $5.2 \times 10^3$ | $1.2 \times 10^3$ | $8.3 \times 10^3$ | 6.9 | 0.74 | 1.05 | 1.42 |
| Comp. 3 | Cyan (C) | $4.5 \times 10^{10}$ | $6.6 \times 10^4$ | $1.6 \times 10^4$ | $2.1 \times 10^5$ | 13.1 | 0.86 | 1.10 | 1.28 |
| Comp. 4 | Cyan (D) | $1.1 \times 10^{10}$ | $8.1 \times 10^7$ | $1.8 \times 10^7$ | $3.1 \times 10^8$ | 17.2 | 0.73 | 0.99 | 1.36 |
| Comp. 5 | Cyan (E) | $1.1 \times 10^6$ | $7.8 \times 10^2$ | $1.8 \times 10^2$ | $2.9 \times 10^3$ | 16.1 | 0.71 | 0.54 | 0.76 |

TABLE 4-2-continued

| Toner (Viscoelasticity) | | | | | | | | | |
|---|---|---|---|---|---|---|---|---|---|
| | | Storage modulus (G') | | | | | | | |
| | | | | 120–180° C. | | | | | |
| Example | Toner | at 80° C. | at 120° C. | min (G' min) | max (G' max) | 120–180° C. G' max/G' min | tan $\delta_{min}$ | tan $\delta_{180}$ | tan $\delta_{180}$/ tan $\delta_{min}$ |
| Comp. 6 | Cyan (F) | $4.5 \times 10^6$ | $6.8 \times 10^4$ | $1.8 \times 10^4$ | $1.1 \times 10^5$ | 6.1 | 0.73 | 1.08 | 1.48 |
| Comp. 7 | Magenta (A) | $2.3 \times 10^{10}$ | $4.6 \times 10^7$ | $2.1 \times 10^7$ | $5.7 \times 10^8$ | 27.1 | 0.80 | 1.02 | 1.28 |
| Comp. 8 | Yellow (A) | $2.5 \times 10^9$ | $4.6 \times 10^7$ | $2.2 \times 10^7$ | $5.6 \times 10^8$ | 25.5 | 0.81 | 1.02 | 1.26 |
| Comp. 9 | Black (A) | $8.7 \times 10^9$ | $3.2 \times 10^7$ | $1.1 \times 10^7$ | $3.1 \times 10^8$ | 28.2 | 0.80 | 1.01 | 1.26 |

TABLE 4-3

| Toner (Other physical properties) | | | | | | | | | | | |
|---|---|---|---|---|---|---|---|---|---|---|---|
| | | DSC | | Molecular weight distribution (GPC) | | | | Particle size distribution (Coulter) | | | |
| | | peaks (° C.) | | Mw | | | Mw/Mn | D4 | D1 | ≦4 μm | ≧12.70 μm |
| Example | Toner | $T_{abs\cdot max}$ | $T_{evo\cdot max}$ | Mp | (×100) | Mn | (×100) | (μm) | (μm) | (% N) | (% V) |
| 1 | Cyan (1) | 68.1 | 63.9 | 8800 | 17500 | 3500 | 5.0 | 7.6 | 6.4 | 9.0 | 0.9 |
| 2 | Cyan (2) | 67.2 | 62.5 | 8300 | 12635 | 3700 | 3.4 | 8.0 | 6.5 | 8.5 | 1.1 |
| 3 | Cyan (3) | 66.9 | 62.2 | 8200 | 13600 | 3650 | 3.7 | 7.9 | 6.0 | 19.1 | 2.0 |
| 4 | Cyan (4) | 73.2 | 68.8 | 9700 | 14900 | 4740 | 3.1 | 8.1 | 6.2 | 17.6 | 1.9 |
| 5 | Cyan (5) | 67.7 | 64.4 | 8400 | 13700 | 3770 | 3.6 | 8.3 | 6.6 | 9.3 | 1.7 |
| 6 | Cyan (6) | 62.0 | 57.8 | 6500 | 12400 | 2700 | 4.6 | 8.0 | 6.5 | 9.2 | 1.3 |
| 7 | Cyan (7) | 99.0 | 84.7 | 14600 | 19100 | 6500 | 2.9 | 7.8 | 6.6 | 9.0 | 1.0 |
| 8 | Cyan (8) | 109.0 | 89.7 | 12800 | 18000 | 6100 | 3.0 | 8.1 | 6.7 | 8.7 | 1.4 |
| 9 | Magenta (1) | 67.7 | 63.4 | 8500 | 13700 | 3700 | 3.7 | 7.7 | 6.5 | 9.5 | 1.0 |
| 10 | Yellow (1) | 68.2 | 62.2 | 8700 | 13600 | 3800 | 3.6 | 7.5 | 6.3 | 10.0 | 0.8 |
| 11 | Black (1) | 67.5 | 61.9 | 8300 | 13700 | 3800 | 3.6 | 8.3 | 6.7 | 9.5 | 1.8 |
| 12 | Cyan (9) | 68.1 | 63.9 | 8800 | 17500 | 3500 | 5.0 | 4.1 | 3.9 | 53.3 | 0.0 |
| 13 | Cyan (10) | 68.1 | 63.9 | 8800 | 17500 | 3500 | 5.0 | 9.9 | 7.8 | 8.1 | 6.1 |
| 14 | Cyan (11) | 69.2 | 64.0 | 8000 | 13598 | 3560 | 3.8 | 8.8 | 6.8 | 13.0 | 2.5 |
| Comp. 1 | Cyan (A) | 69.5 | 63.5 | 19000 | 16700 | 5970 | 2.8 | 7.7 | 6.4 | 9.3 | 0.9 |
| Comp. 2 | Cyan (B) | 66.5 | 61.2 | 4500 | 13800 | 2600 | 5.3 | 8.0 | 6.5 | 9.1 | 1.4 |
| Comp. 3 | Cyan (C) | 65.7 | 63.0 | 16400 | 14400 | 4660 | 3.1 | 7.9 | 6.6 | 9.2 | 1.1 |
| Comp. 4 | Cyan (D) | 68.8 | 60.9 | 17000 | 15500 | 4430 | 3.5 | 7.7 | 6.4 | 9.5 | 1.0 |
| Comp. 5 | Cyan (E) | 55.1 | 50.8 | 6500 | 7100 | 1500 | 4.7 | 7.8 | 6.6 | 9.2 | 1.0 |
| Comp. 6 | Cyan (F) | 49.0 | 45.4 | 7900 | 13200 | 3100 | 4.3 | 7.9 | 6.5 | 9.2 | 1.1 |
| Comp. 7 | Magenta (A) | 69.5 | 63.3 | 18800 | 16700 | 6000 | 2.8 | 7.6 | 6.4 | 9.9 | 1.0 |
| Comp. 8 | Yellow (A) | 69.6 | 63.5 | 18700 | 16600 | 6100 | 2.7 | 7.7 | 6.5 | 9.7 | 0.9 |
| Comp. 9 | Black (A) | 69.5 | 63.5 | 17800 | 15600 | 5300 | 2.9 | 7.7 | 6.5 | 9.8 | 0.9 |

TABLE 5-1

| Toner performances (1) | | | | |
|---|---|---|---|---|
| | Fixable temp. range (° C.) | | Transparency | Anti- |
| Example | $T_{FI}$ (° C.) | $T_{OFFSET}$ (° C.) | for OHP | block |
| 1 | 115 | 230 | A | A |
| 2 | 130 | 210 | A | A |
| 3 | 120 | 230 | A | A |
| 4 | 130 | 230 | B | A |
| 5 | 120 | 210 | A | A |
| 6 | 115 | 200 | A | B |
| 7 | 130 | 230 | B | A |
| 8 | 130 | 230 | B | A |
| 9 (Magenta) | 130 | 225 | A | A |
| 10 (Yellow) | 120 | 200 | A | A |
| 11 (Black) | 130 | 230 | A | A |
| 12 | 130 | 230 | A | A |
| 13 | 130 | 230 | A | B |
| 14 | 130 | 220 | A | B |

TABLE 5-1-continued

| Toner performances (1) | | | | |
|---|---|---|---|---|
| | Fixable temp. range (° C.) | | Transparency | Anti- |
| Example | $T_{FI}$ (° C.) | $T_{OFFSET}$ (° C.) | for OHP | block |
| Comp. 1 | 160 | 235 | C | A |
| Comp. 2 | 110 | 150 | B | D |
| Comp. 3 | 140 | 190 | D | C |
| Comp. 4 | 160 | 240 | D | A |
| Comp. 5 | 100 | 120 | D | D |
| Comp. 6 | 110 | 170 | D | D |
| Comp. 7 | 160 | 230 | D | D |
| Comp. 8 | 160 | 230 | D | D |
| Comp. 9 | 150 | 220 | D | D |

TABLE 5-2

Toner performances (2)

| Example | Image density (Macbeth) NT/NH (23° C./60% RH) Initial/After 10000 sheets | HT/HH (30° C./80% RH) Initial/After 10000 sheets | NT/LH (23° C./5% RH) Initial/After 10000 sheets | Transfer rate (%) Initial | After 10000 sheets |
|---|---|---|---|---|---|
| 1 | 1.76/stable* | 1.79/stable* | 1.70/stable* | 95 | 95 |
| 2 | 1.73/stable | 1.75/stable | 1.68/stable | 96 | 94 |
| 3 | 1.73/1.64 | 1.77/1.68 | 1.69/1.59 | 94 | 94 |
| 4 | 1.72/stable | 1.75/stable | 1.67/1.55 | 95 | 93 |
| 5 | 1.73/stable | 1.78/stable | 1.68/stable | 95 | 94 |
| 6 | 1.71/stable | 1.75/stable | 1.67/stable | 93 | 93 |
| 7 | 1.72/stable | 1.77/stable | 1.65/stable | 95 | 93 |
| 8 | 1.73/stable | 1.75/stable | 1.68/stable | 95 | 93 |
| 9 (Magenta) | 1.74/stable | 1.75/stable | 1.72/stable | 95 | 94 |
| 10 (Yellow) | 1.73/1.66 | 1.79/1.72 | 1.68/1.61 | 94 | 93 |
| 11 (Black) | 1.75/stable | 1.77/stable | 1.72/stable | 93 | 92 |
| 12 | 1.74/1.66 | 1.77/1.70 | 1.68/1.57 | 92 | 90 |
| 13 | 1.74/stable | 1.78/stable | 1.69/stable | 95 | 95 |
| 14 | 1.69/1.57 | 1.75/1.63 | 1.62/1.50 | 93 | 90 |
| Comp. 1 | 1.61/stable | 1.65/stable | 1.57/1.40 | 92 | 86 |
| Comp. 2 | 1.64/stable | 1.71/stable | 1.62/stable | 90 | 90 |
| Comp. 3 | 1.60/stable | 1.65/stable | 1.55/1.38 | 92 | 84 |
| Comp. 4 | 1.60/stable | 1.65/stable | 1.55/1.38 | 92 | 80 |
| Comp. 5 | 1.90/1.21 | 1.95/1.10 | 1.86/1.29 | 92 | 67 |
| Comp. 6 | 1.79/1.55 | 1.85/1.60 | 1.72/1.51 | 92 | 83 |
| Comp. 7 (Magenta) | 1.58/stable | 1.62/stable | 1.54/1.37 | 92 | 86 |
| Comp. 8 (Yellow) | 1.59/stable | 1.63/stable | 1.55/1.38 | 91 | 85 |
| Comp. 9 (Black) | 1.56/stable | 1.60/stable | 1.52/1.35 | 90 | 85 |

*"stable" represents that the density change was within ±0.05 compared with the initial stage value.

What is claimed is:

1. A toner, comprising: at least a binder resin, a colorant and a wax, wherein the toner has viscoelasticity including: a storage modulus at 80° C. ($G'_{80}$) in a range of $1\times10^6$–$1\times10^8$ dN/m$^2$, storage moduli at temperatures of 120–180° C. ($G'_{120-180}$) in a range of $1\times10^4$–$5\times10^5$ dN/m$^2$ and loss tangents (tan δ=G"/G' as a ratio between G" (loss modulus) and G' (storage molecules)) including a loss tangent at 180° C. (tan $\delta_{min}$) and a minimum of loss tangents over a temperature range of 120–180° C. (tan $\delta_{min}$) satisfying $1 \leqq \tan\delta_{180}/\tan\delta_{min}$, the toner exhibits a thermal behavior providing a heat-absorption curve according to differential scanning calorimetry (DSC) showing a maximum heat-absorption peak temperature in a range of 50–110° C. in a temperature range of 30–200° C., and the binder resin comprises a hybrid resin comprising a polyester unit and a vinyl copolymer unit.

2. The toner according to claim 1, wherein the toner exhibits a ratio (G'max/G'min) of at most 20 between a maximum (G'max) and a minimum (G'min) of storage moduli in a temperature range of 120–180° C.

3. The toner according to claim 1, wherein the toner exhibits a thermal behavior providing a heat-absorption curve according to differential scanning calorimetry (DSC) showing a maximum heat-absorption peak temperature in a range of 55–100° C. in a temperature range of 30–200° C.

4. The toner according to claim 1, wherein the toner exhibits a thermal behavior providing a heat-absorption curve according to differential scanning calorimetry (DSC) showing a maximum heat-absorption peak temperature in a range of 60–90° C. in a temperature range of 30–200° C.

5. The toner according to claim 1, wherein the toner further contains an organometallic compound.

6. The toner according to claim 5, wherein the organometallic compound is a metal compound of an aromatic carboxylic acid derivative.

7. The toner according to claim 6, wherein the organometallic compound is an aluminum compound of aromatic carboxylic acid derivative.

8. The toner according to claim 1, wherein the binder resin comprises a mixture of a polyester resin and a vinyl copolymer.

9. The toner according to claim 1, wherein the toner exhibits a thermal behavior providing a heat-evolution curve according to differential scanning calorimetry (DSC) showing a maximum heat-evolution peak temperature in a range of 40–90° C. in a temperature range of 30–200° C.

10. The toner according to claim 1, wherein the toner exhibits a thermal behavior providing a heat-evolution curve according to differential scanning calorimetry (DSC) showing a maximum heat-evolution peak temperature in a range of 45–85° C. in a temperature range of 30–200° C.

11. The toner according to claim 1, wherein the toner contains a tetrahydrofuran-soluble resin component exhibiting a molecular weight distribution according to GPC (gel permeation chromatography) including a main peak in a molecular weight region of 3500–15000, and a ratio (Mw/Mn) of at least 300 between weight-average molecular weight (Mw) and number-average molecular weight (Mn).

12. The toner according to claim 1, wherein the toner contains a tetrahydrofuran-soluble resin component exhibiting a molecular weight distribution according to GPC (gel permeation chromatography) including a main peak in a molecular weight region of 3500–15000, and a ratio (Mw/Mn) of at least 500 between weight-average molecular weight (Mw) and number-average molecular weight (Mn).

13. The toner according to claim 1, wherein the toner has a weight-average particle size of 4–10 $\mu$m.

14. The toner according to claim 5, wherein the toner exhibits a storage modulus at 80° C. ($G'_{80}$) in a range of $1\times10^6$–$1\times10^8$ dN/m$^2$, and storage moduli at temperatures of 120–180° C. ($G'_{120\text{-}180}$) in a range of $1\times10^4$–$5\times10^5$ dN/m$^2$.

15. The toner according to claim 5, wherein the toner exhibits a ratio (G'max/G'min) of at most 20 between a maximum (G'max) and a minimum (G'min) of storage moduli in a temperature range of 120–180° C.

16. The toner according to claim 5, wherein the toner exhibits a thermal behavior providing a heat-absorption curve according to differential scanning calorimetry (DSC) showing a maximum heat-absorption peak temperature in a range of 55–100° C. in a temperature range of 30–200° C.

17. The toner according to claim 5, wherein the toner exhibits a thermal behavior providing a heat-absorption curve according to differential scanning calorimetry (DSC) showing a maximum heat-absorption peak temperature in a range of 60–90° C. in a temperature range of 30–200° C.

18. The toner according to claim 5, wherein the binder resin comprises a hybrid resin comprising a polyester unit and a vinyl copolymer unit.

19. The toner according to claim 5, wherein the binder resin comprises a mixture of a polyester resin and a vinyl copolymer.

20. The toner according to claim 5, wherein the toner exhibits a thermal behavior providing a heat-evolution curve according to differential scanning calorimetry (DSC) showing a maximum heat-evolution peak temperature in a range of 40–90° C. in a temperature range of 30–200° C.

21. The toner according to claim 5, wherein the toner exhibits a thermal behavior providing a heat-evolution curve according to differential scanning calorimetry (DSC) showing a maximum heat-evolution peak temperature in a range of 45–85° C. in a temperature range of 30–200° C.

22. The toner according to claim 5, wherein the toner contains a tetrahydrofuran-soluble resin component exhibiting a molecular weight distribution according to GPC (gel permeation chromatography) including a main peak in a molecular weight region of 3500–15000, and a ratio (Mw/Mn) of at least 300 between weight-average molecular weight (Mw) and number-average molecular weight (Mn).

23. The toner according to claim 5, wherein the toner contains a tetrahydrofuran-soluble resin component exhibiting a molecular weight distribution according to GPC (gel permeation chromatography) including a main peak in a molecular weight region of 3500–15000, and a ratio (Mw/Mn) of at least 500 between weight-average molecular weight (Mw) and number-average molecular weight (Mn).

24. The toner according to claim 5, wherein the toner has a weight-average particle size of 4–10 $\mu$m.

25. The toner according to claim 5, wherein the toner has a storage modulus $G'_{80}$ of $1\times10^6$–$9\times10^7$ dN/m$^2$.

26. The toner according to claim 5, wherein the toner has a storage modulus $G'_{80}$ of $2\times10^6$–$5\times10^7$ dN/m$^2$.

27. The toner according to claim 5, wherein the toner has a storage modulus at 120° C. ($G'_{120}$) of $1\times10^4$–$8\times10^5$ dN/m$^2$.

28. The toner according to claim 27, wherein the toner has a storage modulus $G'_{120}$ of $2\times10^4$–$7\times10^5$ dN/m$^2$.

29. An image forming method, comprising:

(A) an image forming cycle including: a step of forming an electrostatic image on an image bearing member, a step of developing the electrostatic image with a color toner to form a color toner image on the image bearing member, and a step of transferring the color toner image onto a transfer material via or without via an intermediate transfer member, (B) a process of repeating the image forming cycle (A) four times by using first to fourth color toners, respectively, to form superposed first to fourth color toner images on the transfer material, and (C) a step of fixing the superposed first to fourth color toner images on the transfer material under application of heat and pressure to form a fixed full-color image on the transfer material, wherein the first to fourth color toners are selected successively in an arbitrary order from the group consisting of a cyan toner, a magenta toner, a yellow toner and a black toner, each of the cyan, magenta, yellow and black toners comprises at least a binder resin, a wax and a corresponding colorant selected from the group consisting of a cyan colorant, a magenta colorant, a yellow colorant and a black colorant, the toner has viscoelasticity including: a storage modulus at 80° C. ($G'_{80}$) in a range of $1\times10^6$–$1\times10^8$ dN/m$^2$, storage moduli at temperatures of 120–180° C. ($G'_{120\text{-}180}$) in a range of $1\times10^4$–$5\times10^5$ dN/m$^2$ and loss tangents (tan $\delta$=G"/G' as a ratio between G" (loss modulus) and G' (storage molecules)) including a loss tangent at 180° C. (tan $\delta_{180}$) and a minimum of loss tangents over a temperature range of 120–180° C. (tan $\delta_{min}$) satisfying $1 \leqq \tan\delta_{180}/\tan\delta_{min}$, the toner exhibits a thermal behavior providing a heat-absorption curve according to differential scanning calorimetry (DSC) showing a maximum heat-absorption peak temperature in a range of 50–110° C. in a temperature range of 30–200° C., and the binder resin comprises a hybrid resin comprising a polyester unit and a vinyl copolymer unit.

30. The image forming method according to claim 29, wherein in the process (B), the image forming cycle (A) is repeated four times by using first to fouth image bearing members, respectively.

31. The image forming method according to claim 29, wherein the toner images are fixed under application of heat and pressure and under application of silicone oil supplied from a fixing member to a fixing surface at a rate of at most $1\times10^{-7}$ g/cm$^2$.

32. The image forming method according to claim 29, wherein the toner images are fixed under application of heat and pressure and under no application of offset-prevention oil from a fixing member to a fixing surface.

33. An image forming method comprising:

(A) an image forming cycle including:

a step of forming an electrostatic image on an image bearing member, a step of developing the electrostatic image with a color toner to form a color toner image on the image bearing member, and a step of transferring the color toner image onto a transfer material via or without via an intermediate transfer member, (B) a process of repeating the image forming cycle (A) four times by using first to fourth color toners, respectively, to form superposed first to fourth color toner images on the transfer material, and (C) a step of fixing the superposed first to fourth color toner images on the transfer material under application of heat and pressure to form a fixed full-color image on the transfer material, wherein the first to fourth color toners are selected successively in an arbitrary order from the group consisting of a cyan toner, a magenta toner, a yellow toner and a black toner, each of the cyan, magenta, yellow and black toners comprises at least a binder resin, a wax and a corresponding colorant selected from the group consisting of a cyan colorant, a magenta colorant, a yellow colorant and a black colorant, the toner has viscoelasticity including: a storage modulus at 80° C. ($G'_{80}$) in a range of $1\times10^6$–$1\times10^8$ dN/m$^2$, storage moduli at temperatures of 120–180° C. ($G'_{120-180}$) in a range of $1\times10^4$–$5\times10^5$ dN/m$^2$, and loss tangents (tan $\delta$=G"/G' as a ratio between G" (loss modulus) and G' (storage molecules)) including a loss tangent at 180° C. (tan $\delta_{180}$) and a minimum of loss tangents over a temperature range of 120–180° C. (tan $\delta_{min}$) satisfying $1 \leqq \tan \delta_{180}/\tan \delta_{min}$, the toner exhibits a thermal behavior providing a heat-absorption curve according to differential scanning calorimetry (DSC) showing a maximum heat-absorption peak temperature in a range of 50–110° C. in a temperature range of 30–200° C., the binder resin comprises a hybrid resin comprising a polyester unit and a vinyl copolymer unit, and wherein at least one of the first to fourth color toners is a toner according to any one of claims 2–7 and 8–28.

* * * * *